United States Patent [19]

Inoue et al.

[11] Patent Number: 4,952,483

[45] Date of Patent: Aug. 28, 1990

[54] DIRECT POSITIVE SILVER HALIDE PHOTOSENSITIVE MATERIAL AND METHOD FOR FORMING DIRECT POSITIVE IMAGE

[75] Inventors: Noriyuki Inoue; Morio Yagihara; Hisashi Okada; Tetunoti Matushita; Satoshi Nagaoka; Tetsuro Kojima, all of Minami-Ashigara, Japan

[73] Assignee: Fuji Photo Film Co., Ltd., Kanagawa, Japan

[21] Appl. No.: 171,356

[22] Filed: Mar. 21, 1988

[30] Foreign Application Priority Data

Mar. 20, 1987 [JP] Japan ..... 62-66790
Mar. 20, 1987 [JP] Japan ..... 62-66791

[51] Int. Cl.[5] ..... G03C 7/00; G03C 1/485

[52] U.S. Cl. ..... 430/378; 430/410; 430/547; 430/598

[58] Field of Search ..... 430/598, 410, 264, 547, 430/378

[56] References Cited

U.S. PATENT DOCUMENTS

| | | | |
|---|---|---|---|
| 3,637,387 | 1/1972 | Vanreusel et al. . | |
| 4,245,037 | 1/1981 | Tsujino et al. | 430/559 |
| 4,278,748 | 7/1981 | Sidhu et al. | 430/212 |
| 4,323,643 | 4/1982 | Mifune et al. | 430/441 |
| 4,481,285 | 11/1984 | Takagi et al. | 430/410 |
| 4,550,070 | 10/1985 | Miyasaka et al. | 430/202 |
| 4,582,779 | 4/1986 | Kubota et al. | 430/409 |
| 4,717,648 | 1/1988 | Ueda et al. | 430/379 |
| 4,749,644 | 6/1988 | Tosaka et al. | 430/544 |

FOREIGN PATENT DOCUMENTS

| | | | |
|---|---|---|---|
| 0130856 | 1/1985 | European Pat. Off. . | |
| 0143436 | 6/1985 | European Pat. Off. . | |
| 0154293 | 11/1985 | European Pat. Off. . | |
| 63-015248 | 1/1988 | Japan | 430/378 |
| 2012443 | 7/1979 | United Kingdom . | |
| 2038012 | 7/1980 | United Kingdom . | |
| 2052880 | 2/1981 | United Kingdom . | |
| 2107074 | 4/1983 | United Kingdom . | |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

The present invention relates to a direct positive silver halide photosensitive material and a method for forming a direct positive image. By the use of a novel nucleating agent having a specific structural formula, the present invention provides a direct positive silver halide photosensitive material with an increased Dmax value and a decreased Dmin value, as compared with the use of the conventional nucleating agents, even if a small amount of the novel nucleating agent is used, and does not substantially reduce the Dmax value, even if the photosensitive material is kept in a high-humidity state for a long time before exposure.

6 Claims, No Drawings

DIRECT POSITIVE SILVER HALIDE PHOTOSENSITIVE MATERIAL AND METHOD FOR FORMING DIRECT POSITIVE IMAGE

BACKGROUND OF THE INVENTION 1. (Technical Field)

The present invention relates to a novel nucleating agent or a direct positive silver halide photosensitive material which comprises the nucleating agent and a nucleation accelerator in combination, and to a method for forming a direct positive image.

2. (Prior Art)

A photographic technique which requires neither a reversal process nor a negative film for obtaining a direct positive image is well known.

Conventional methods of obtaining a direct positive image by using a silver halide photosensitive material are mainly classified into two types in view of their practical usefulness, except for a special type.

One of these types is the method which uses a previously fogged silver halide emulsion and destroys the fogged nuclei of an exposed portion (latent image) by employing solarization or Herschel effect, to obtain a direct positive image.

The other type is the method which uses an unfogged internal latent image-type silver halide emulsion and conducts surface development, after or during fogging treatment after image exposure, to obtain a direct positive image.

The above-described internal latent image-type silver halide photographic emulsion is defined as a silver halide photographic emulsion of a type in which sensitivity specks are mainly contained in the silver halide grains and latent images are mainly formed in the grains by exposure.

The second method offers generally higher sensitivity than the first method and is suitable for applications requiring high sensitivity. The present invention concerns the second method.

Various techniques have been known in this technical field. Typical examples include the techniques described in U.S. Pat. Nos. 2,592,250, 2,466,957, 2,497,875, 2,588,982, 3,317,322, 3,761,266, 3,761,276, and 3,796,577, and British Patent Nos.1151363, 1150553, and 1011062.

These known methods can provide photosensitive materials with relatively high sensitivity, as a direct positive type.

The mechanism of the formation of a direct positive image is described in detail in, for example, T. H. James, "The Theory of The Photographic Process" 4th Edition, Chapter 7, pp. 182-193 and U.S. Pat. No.3,761,276.

Specifically, it has been believed that a photographic image (direct positive image) is formed in an unexposed portion by selectively forming fogged nuclei only on the surfaces of the silver halide grains in the unexposed portion using surface desensitization due to so-called internal latent images which are produced in silver halide grains by the first imagewise exposure and then performing a so-called usual surface development.

Known means for forming selectively fogged nuclei, as described above, include a method generally called "light fogging method" which provides a second exposure on the entire surface of a photosensitive layer (as disclosed, for example, in British Patent No.1,151,363) and a method generally called "chemical fogging method" which uses a nucleating agent. The latter method is described in, for example, "Research Disclosure" Vol. 151, No.15162, pp. 76–78 (issued in November, 1976).

(Problems to be Solved by the Invention)

However, the light fogging method has problems in that it requires a specific apparatus for irradiating rays of light and that color reproducibility strongly depends upon the amount and spectral properties of light used for fogging.

On the other hand, the chemical fogging method uses various types of nucleatinag agents, and, as disclosed in Japanese Patent Publication No.61-153902, uses various types of hydrazine compounds and quaternary salts as a nucleating agent.

However, such conventional hydrazine compounds have no groups in a molecule, which groups can dissociate into an anion and have a pKa value of 6 or more and therefore their use as a nucleating agent does not highly increase the Dmax of the direct positive images than expected. In addition, the quaternary salts which completely differ from the hydrazine compounds in their structures have a problem that photosensitive materials exhibit poor storage qualities and thus that the Dmax values decrease at high humidity.

In addition, when a core/shell emulsion of silver chlorobromide is used as an internal latent image-type silver halide emulsion, the speed of development is advantageously high. However, the Dmin value is easily increased in the presence of a conventional hydrazine compound as a nucleating agent after the photosensitive material has been stored. Consequently, there has been a demand for photosensitive materials having excellent storage qualities and high speeds of development.

Dmax can be increased when the pH of a developer is 12 or more, but the developer rapidly deteriorates and loses storage properties. Therefore, there has also been a demand for color developers which produce high Dmax values within a lower pH range below 12 and which have none of the above-described problems. In the case of color development within a pH range below 11.5, however, Dmax could not be greatly increased, particularly in the presence of a conventional hydrazine compound as a nucleating agent. Therefore, there has been a strong demand for a method of forming a direct positive image, which can perform color development wherein the resultant developed material has a high Dmax value within a lower pH range below 11.5.

SUMMARY OF THE INVENTION

It is an object of the present invention to provide a photosensitive material which can increase Dmax even using a small amount of the present nucleating agent and reduce Dmin, as compared with the use of a conventional nucleating agent, and which hardly reduces Dmax even if it is stored under high humidity conditions for a long time before exposure.

It is another object of the present invention to provide a method of forming a direct positive image which has a high Dmax and a low Dmin.

The inventors of the present invention have unexpectedly discovered a photosensitive material and a method for forming images which can achieve the above-described objects by utilizing the present nucleating agents described below in place of a conventional nucleating agent.

The inventors also found that the combination of the novel nucleating agent with a nucleation accelerator for the purpose of accelerating the nucleation effect can prevent a reverse negative image from being produced on a direct positive image and can faithfully reproduce the original color. The present invention has been achieved on the basis of these new findings.

In other words, the present invention relates to:

1. a direct positive silver halide photosensitive material comprising a previously unfogged internal latent image-type silver halide emulsion and a nucleating agent expressed by the following formula (I):

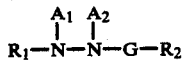

(wherein $A_1$ and $A_2$ both denote a hydrogen atom, or one of $A_1$ and $A_2$ denotes a hydrogen atom and the other a sulfinic acid residue or an acyl group; $R_1$ denotes an aliphatic, aromatic or heterocyclic group; $R_2$ denotes a hydrogen atom or an alkyl, aryl, alkoxyl, aryloxy or amino group, at least one of $R_1$ and $R_2$ having at least one substituent which can dissociate into an anion and has a pKa of 6 or more; and G denotes a carbonyl, sulfonyl, sulfoxy, phosphoryl, or iminomethylene group); and 2. a method for forming a direct positive image comprising imagewise exposing a photosensitive material containing at least one layer of a previously unfogged internal latent image-type silver halide emulsion on a support and then conducting a surface color developing in the presence of a nucleating agent, the nucleating agent being expressed by the above-described formula (I) and, if required, being used in combination with a nulceation accelerator.

The present invention will be described in detail below.

The new hydrazine compound used in the present invention is expressed by the following formula (I):

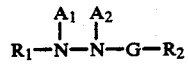

(wherein $A_1$ and $A_2$ both denote a hydrogen atom, or one of $A_1$ and $A_2$ denotes a hydrogen atom and the other a sulfinic acid residue or an acyl group; $R_1$ denotes an aliphatic, aromatic or heterocyclic group; $R_2$ denotes a hydrogen atom or a substituted or unsubstituted alkyl, aryl, alkoxyl, aryloxy or amino group; and G denotes a carbonyl, sulfonyl, sulfoxy, phosphoryl, or N-substituted or unsubstituted iminomethylene group; at least one of $R_1$ and $R_2$ having at least one substituent which can dissociate into an anion and has a pKa of 6 or more.

Examples of an aliphatic group denoted by $R_1$ in Formula (I) include straight, branched or cyclic alkyl, alkenyl and alkynyl groups.

Examples of an aromatic group denoted by $R_1$ include monocyclic or bicyclic aryl groups such as a phenyl and naphthyl group.

Examples of a heterocyclic group denoted by $R_1$ include 3- to 10-member saturated or unsaturated heterocyclic groups containing at least one of N, O and S atoms. These heterocyclic groups may be a monocyclic group or form a condensed ring with another aromatic ring or heterocyclic ring. Preferable examples of heterocylic groups include 5- or 6-member aromatic heterocyclic groups such as a pyridine, imidazolyl, quinolynyl, pyrazolyl, isoquinolynyl, thiazolyl and benzthiazolyl group.

$R_1$ may be substituted by a substituent. Examples of substituents include alkyl groups, aralkyl groups, alkoxyl groups, aryl groups, substituted amino groups, acylamino groups, sulfonylamino groups, ureido groups, urethane groups, aryloxy groups, sulfamoyl groups, carbamoyl groups, aryl groups, alkylthio groups, arylthio groups, a sulfonyl group, a sulfinyl group, a hydroxyl group, halogen atoms, a cyano group, a sulfo group and a carboxyl group. These groups may be further substituted and, if possible, may be confined with each other to form a ring.

A group denoted by $R_1$ is preferably an aromatic group, and more preferably an aryl group.

When G is a carbonyl group, preferable examples of a group denoted by $R_2$ include a hydrogen atom; alkyl groups such as a methyl, trifluoromethyl, 3-hydroxypropyl, and 3-methanesulfonamidopropyl group; aralkyl groups such as an o-hydroxybenzyl group; and aryl groups such as a phenyl 3,5-dichlorophenyl, o-methanesulfonamidophenyl and 4-methanesulfonylphenyl group. A hydrogen atom is particularly preferable.

When G is a sulfonyl group, preferable examples of a group denoted by $R_2$ include alkyl groups such as methyl group; aralkyl groups such as an o-hydroxyphenylmethyl group; aryl groups such as a phenyl group; and amino groups such as a dimethylamino group.

When G is a sulfoxyl group, preferable examples of a group denoted by $R_2$ include a cyanobenzyl group and a methylthiobenzyl group, and when G is a N-substituted or unsubstituted iminomethylene group, preferable examples of a group denoted by $R_2$ include a methyl, ethyl, and substituted and unsubstituted phenyl group.

When G is a phosphoryl group, preferable examples of a group denoted by $R_2$ include a methoxy, ethoxy, butoxy, phenoxy, and phenyl group. A phenoxy group is particularly preferable.

Examples of a substituent for $R_2$ include the above-described substituents for $R_1$, acyl groups, acyloxy groups, alkyl or aryloxycarbonyl groups, alkenyl groups, alkynyl groups, and a nitro group.

These substituents may be further substituted by these groups, and, if possible, may be connected to each other to form a ring.

$R_1$ and $R_2$, particularly $R_1$, preferably contains a nondiffusible group, a so-called ballast group, of a coupler. The ballast group consists of 8 or more carbon atoms and comprises a combination of one or more groups of alkyl, phenyl, ether, amido, ureido, urethane, sulfonamido and thioether group.

$R_1$ or $R_2$ may contain a group $X_1$-(-$L_1$-)-$_m$ which accelerates the adsorption of the compound expressed by Formula (I) on the surface of a silver halide grain. In this formula, $X_1$ denotes a group for accelerating the adsorption on the silver halide, $L_1$ denotes a bivalent connecting group, and m denotes 0 or 1.

Preferable examples of an adsorption accelerating group denoted by $X_1$ include thioamido groups, mercapto groups and nitrogen-containing 5- or 6-member heterocylic groups.

The thioamido adsorption accelerating groups denoted by $X_1$ may be bivalent expressed by

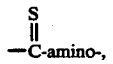

part of the structure of a ring or an acylic thioamido group. A useful thioamido adsorption accelerating group can be selected from the groups disclosed in U.S. Pat. Nos. 4,030,925, 4,031,127, 4,080,207, 4,245,037, 4,255,511, 4,266,013, and 4,276,364; and Research Disclosure, Vol. 151, No.15162 (November, 1976), and Vol. 176, No.17626 (December, 1978).

Examples of an acyclic thioamido group include a thioureido, thiourethane and dithiocarbamic ester group; and examples of a cyclic thioamido group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazolinel-2-thione, 1,3,4-oxadiozoline-2-thione, benzimidazoline-2-thione, benzoxazoline-2-thione and benzothiazoline-2-thione. These groups may be further substituted.

Examples of a mercapto group denoted by $X_1$ include aliphatic mercapto groups, aromatic mercapto groups and heterocyclic mercapto groups (the same as cyclic thioamido groups which are tautomers with the compound wherein a nitrogen atom is present adjacent to the carbon atoms to which an —SH group is bonded, and examples of the cyclic thioamido groups are described above).

Examples of a nitrogen-containing 5- or 6-member heterocyclic group denoted by $X_1$ include nitrogen-containing 5- or 6-member heterocyclic rings consisting of nitrogen, oxygen, sulfur and carbon, in combination. Preferable examples of the heterocyclic rings include benzotriazole, triazole, tetrazole, indazole, benzimidazole imidazole, benzothiazole, thiazole, benzoxazole, oxazole, thiadiazole, oxadiazole and triazine. These rings may be further substituted by a suitable substituent.

Examples of the substituents include the substituents for $R_1$.

Preferable examples among the groups denoted by $X_1$ include cyclic thioamido groups (i.e. mercapto-substituted nitrogen-containing heterocyclic groups such as 2-mercaptothiadiazole, 3-mercapto-1,2,4-triazole, 5-mercaptotetrazole, 2-mercapto-1,3,4-oxadiazole and 2-mercaptobenzoxazole group) and nitrogen-containing heterocyclic groups such as benzotriazole, benzimidazole and indazole group.

A bivalent connecting group denoted by $L_1$ is an atom of C, N, S or O, or an atomic group comprising at least one of these atoms. Examples of the connecting group include alkylene, alkenylene, alkynylene and arylene groups, and —O—, —S—, —NH—, —N=, —CO— and —$SO_2$—(these groups may have substituents) singly or as a combination thereof.

Examples of groups denoted by $A_1$, $A_2$ include a hydrogen atom, alkylsulfonyl and arylsulfonyl groups having 20 or less carbon atoms (preferably a phenylsulfonyl group or a phenylsulfonyl group which is substituted so as to have a sum of Hammett's substituent constants of −0.5 or more), acyl groups having 20 or less carbon atoms (preferably a benzoyl group or a benzoyl group substituted so as to have a sum of Hammett's substituent constants of −0.5 or more), and straight, branched or cyclic unsubstituted or substituted aliphatic acyl groups (examples of substituents include a halogen atom, and ether, sulfonamido, carbonamido, hydroxyl, carboxyl and sulfonic acid groups). Examples of sulfinic acid residues denoted by $A_1$ and $A_2$ are described in U.S. Pat. No. 4,478,928.

Hydrogen atoms are particularly preferable as $A_1$ and $A_2$. A carbonyl group is particularly preferable as G of Formula (I).

A substituent which can dissociate into an anion and has a pKa of 6 or more is preferably a substituent which can dissociate into an anion and has a pKa value of 8 to 13. It may be any one of substituents so long as it hardly dissociates in a neutral or weakly acid medium but it sufficiently dissociates in an aqueous alkali solution (preferably at pH 10.5 to 12.3) such as a developer. There is no need to be a particular substituent.

Examples of a substituent include a hydroxyl group, a group expressed by $R_3SO_2NH$—(wherein $R_3$ denotes an alkyl group, an aryl group, a heterocyclic group or —$L_2$—$X_1$ ($L_2$ denotes the same as $L_1$ described above), and these groups may have a substituent), a mercapto group, a hydroxyimino group

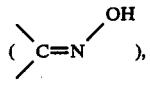

an active methine group, and an active methylene group such as —$CH_2COOC_2H_5$, —$CH_2COCH_3$ or

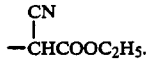

Preferable examples of the compound expressed by Formula (I) include those compounds expressed by the following formula (I-A):.

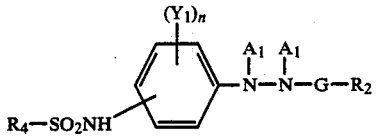

(wherein $Y_1$) denotes a substituent (examples thereof include the same as those for $R_1$ of Formula (I)) or a substituent which has a pKa of 6 or more and can dissociate into an anion (examples thereof include the same as those of Formula (I)); n denotes 0, 1 or 2, and when n is 2, $Y_1$'s may be the same as or different from each other; $R_4$ denotes the same as $R_1$ of Formula (I) or $\cancel{(}L_1\cancel{)}_m X_1$, preferably $\cancel{(}L_1\cancel{)}_m$—$X_1$ ($L_1$ and $X_1$ denotes the same as those of Formula (I)); m denotes 0 or 1; and G, $R_2$, $A_1$ and $A_2$ denote the same as those of Formula (I)).

The $R_4SO_2NH$ group is preferably substituted at the p-position relative to the acylhydrazino group.

Examples of the compound expressed by Formula (I) are given below, but the present invention is not limited to these compounds.

(1)
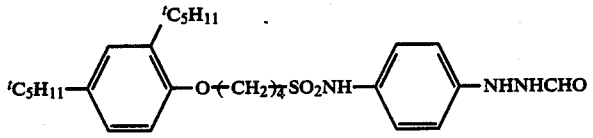
(2)
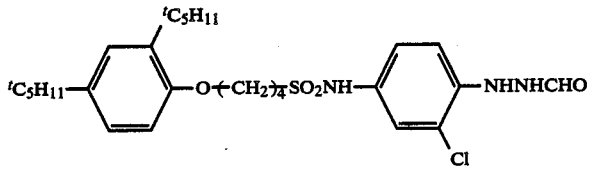
(3)
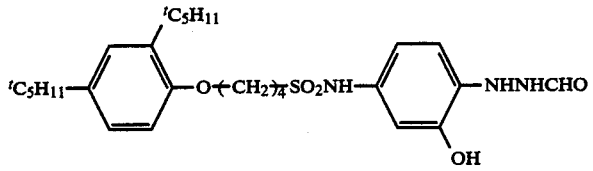
(4)
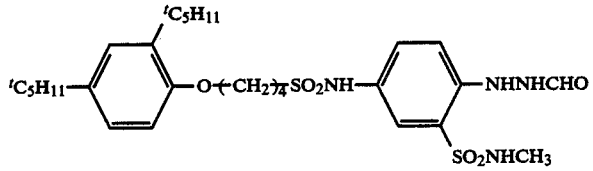
(5)
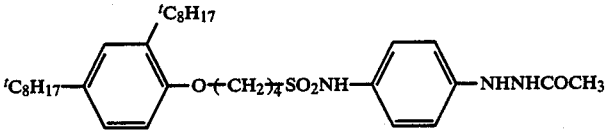
(6)
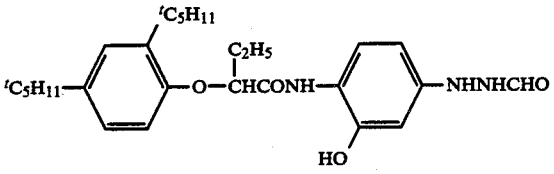
(7)
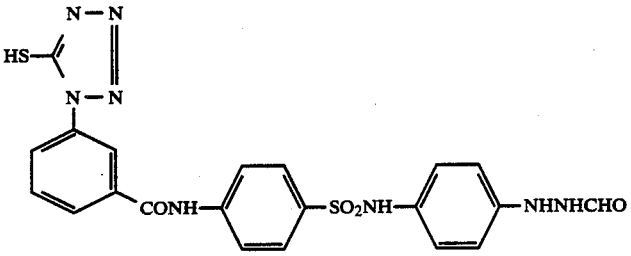
(8)
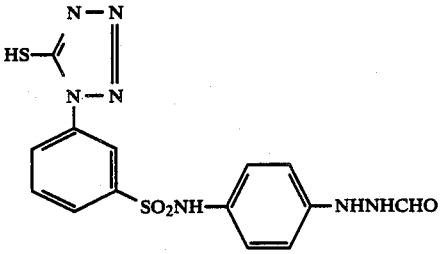

-continued
(9)
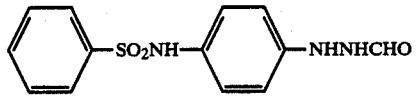
(10)
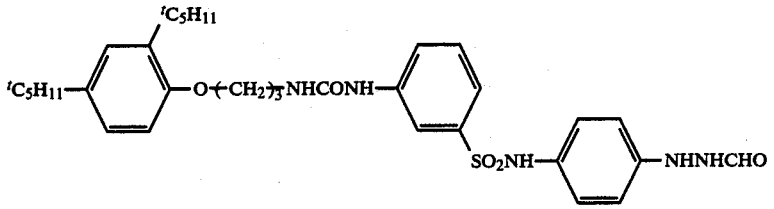
(11)
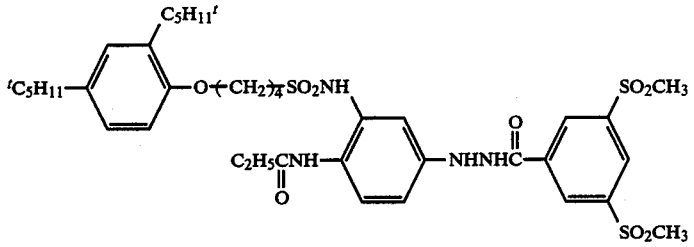
(12)
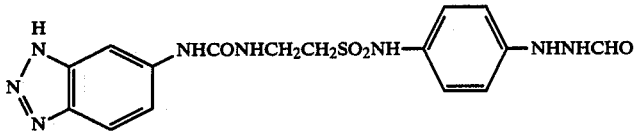
(13)
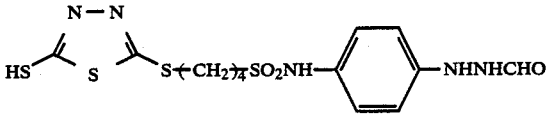
(14)
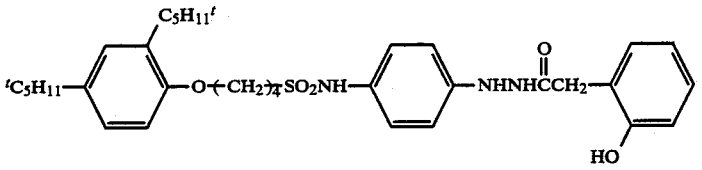
(15)
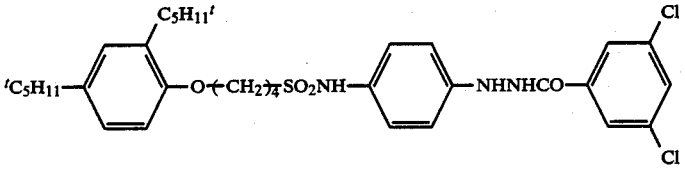
(16)
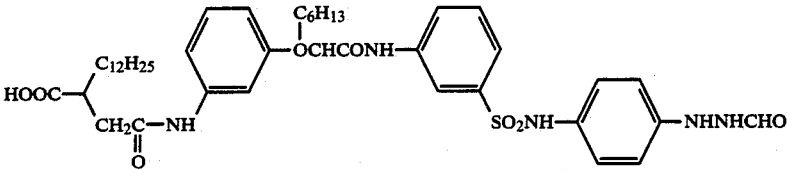

-continued
(17)
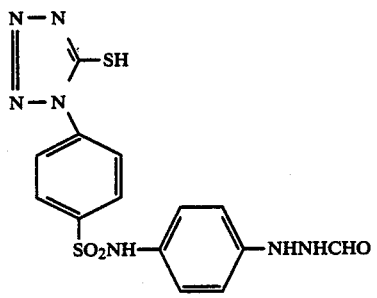
(18)
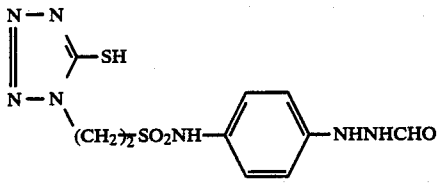
(19)
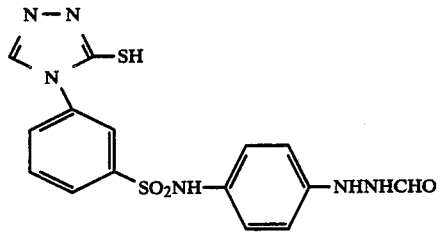
(20)
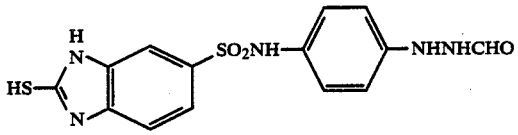
(21)
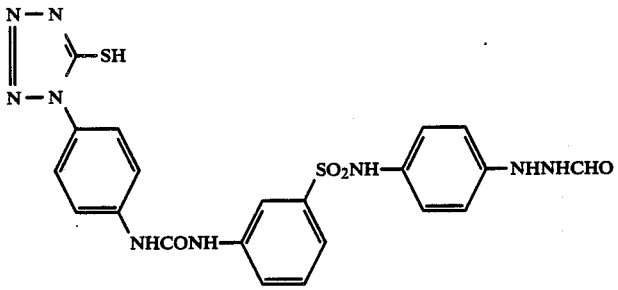
(22)
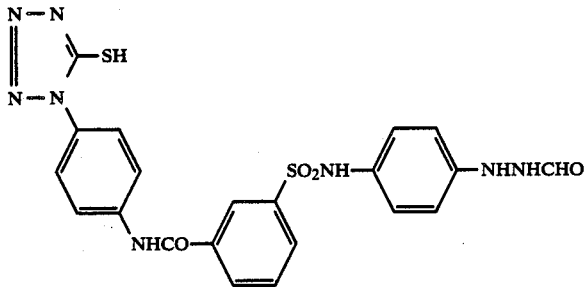

-continued
(23)
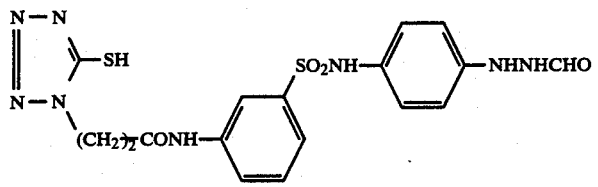
(23)-1
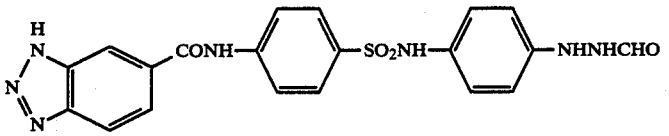
(24)
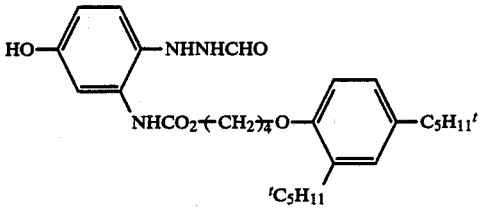
(25)
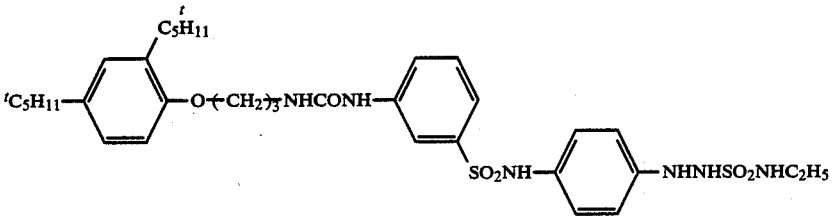
(26)
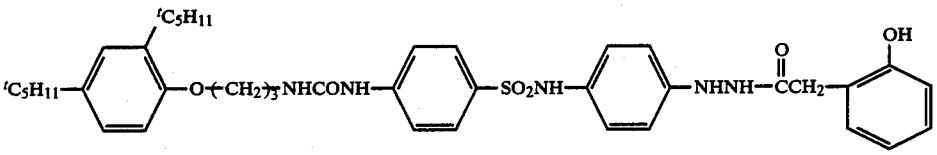
(27)
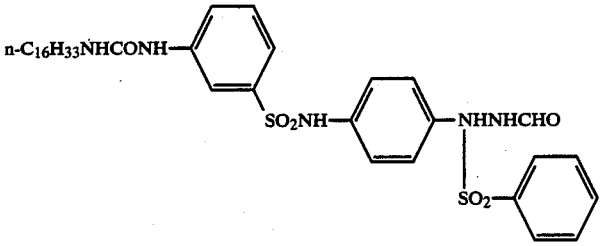
(28)
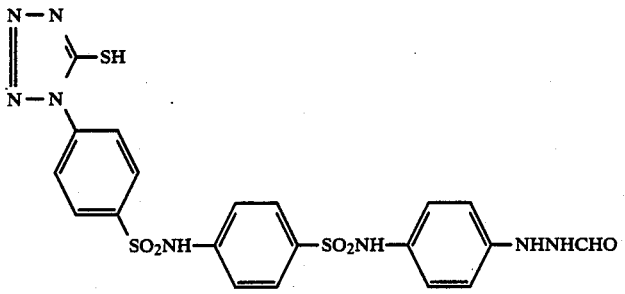

-continued
(29)
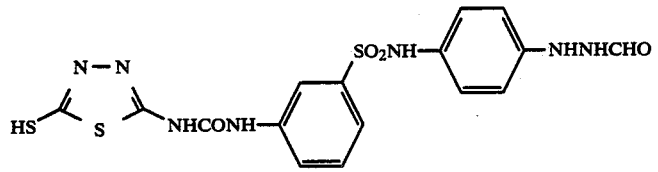
(30)
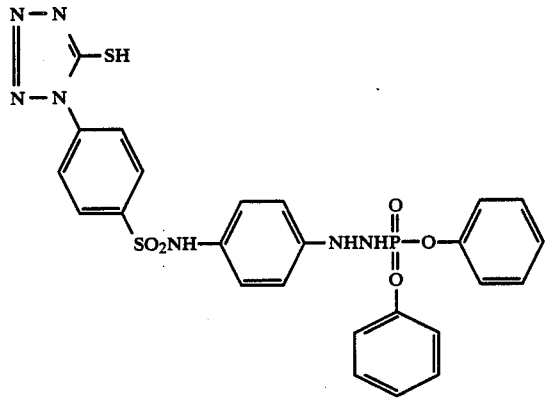
(31)
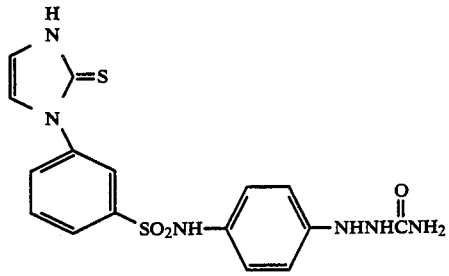
(32)
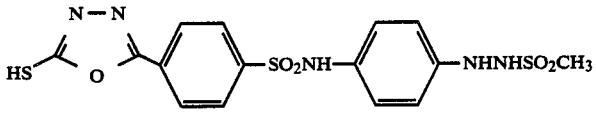
(33)
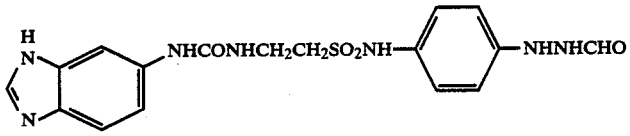
(34)
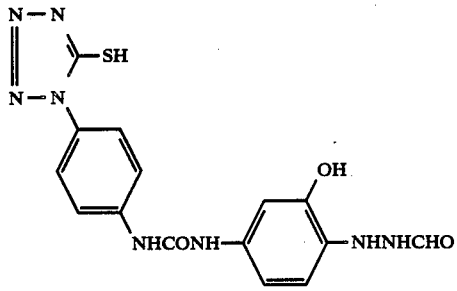

-continued (35)

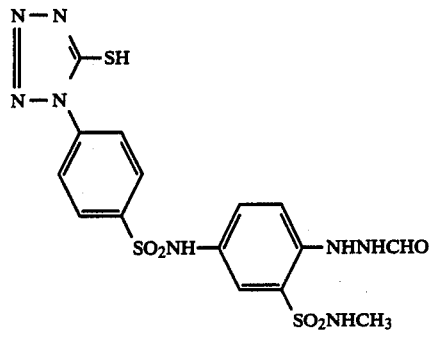

(36)

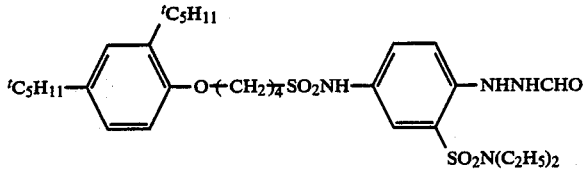

(37)

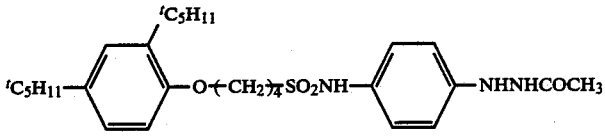

(38)

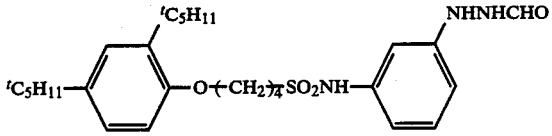

(39)

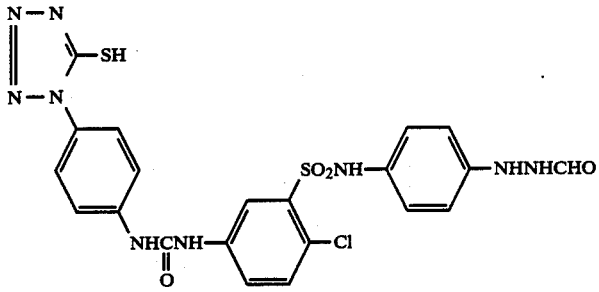

A hydrazine nucleating agent used in the present invention can be generally synthesized by the method described in Japanese Patent Laid-Open No. 56-87843 or 60-179734.

For example, the nucleating agent expressed by Formula (I) can be synthesized by the method described below.

Reaction A

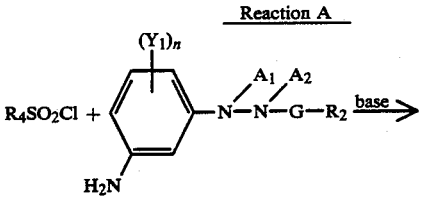

-continued

Reaction A

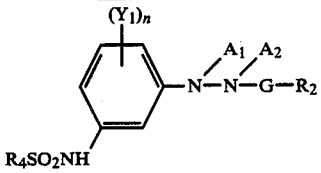

or when $R_4$ is $\text{-}(L_1)_m\text{-}X_1$ such as

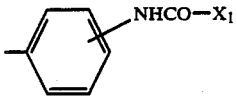

Reaction B $X_1\text{—COOH}$ +

-continued

Reaction B

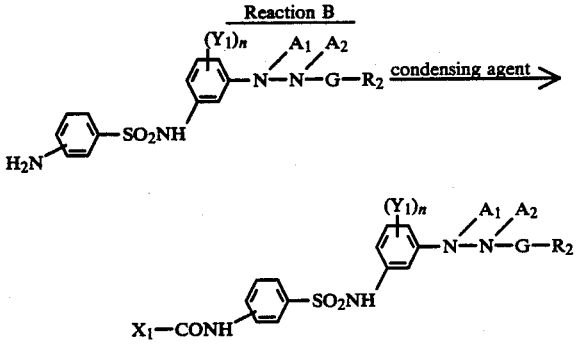

In these reactions, a solvent such as acetonitrile, tetrahydrofuran, dioxane, methylene chloride, chloroform, dimethylformamide or dimethylacetamide can be used. As a base of reaction A, triethylamine, N-ethylpiperidine, N-methylmorpholine or pyridine can be used. As a condensing agent of reaction B, dicyclohexylcarbodimide or carbonylimidazole can be used. A catalyst such as N,N-dimethylaminopyridine, pyrrolodinopyridine or N-hydroxybenzotriazole can be used in combination with the above-described base in order to increase the yield and reduce the reaction time.

The nucleating agent of the present invention can be added to a photosensitive material or its processing solution and is preferably contained in the photosensitive material.

When the nucleating agent is added to the photosensitive material, it is preferably added to a layer of an internal latent image-type silver halide emulsion. It may be added to other layers such as an intermediate, substratum or back layer so far as the nucleating agent is diffused during application or processing so that the nucleating agent is adsorbed to the silver halide. When the nucleating agent is added to the processing solution, it may be contained in a developer or a pre-bath at a low pH, as described in Japanese Patent Laid-Open No.58-178350.

In the present invention, the overall surface exposure, i.e. light fogging exposure, can be used together with the chemical fogging method. This method is performed before and/or during the development after the imagewise exposure. A photosensitive material which has been imagewise exposed is exposed to light in a developer, in a state wherein it is immersed in the pre-bath before the developer, or before it is dried after having been removed from these solutions, preferably exposed to light during the development.

It is sufficient to use a light source generating light within the sensitive wavelengths of a photosensitive material as a light source for the fogging exposure. A fluorescent light lamp, a tungsten lamp, a xenon lamp or sunrays can be generally used. A light source with high color rendering (preferably close to white), as described in Japanese Patent Laid-Open Nos.56-137350 and 58-70223, is suitable for a photosensitive material having the light sensitivity within all the wavelengths, for example, a color photosensitive material. The illuminance is 0.01 to 2000 lux, preferably 0.05 to 30 lux, more preferably 0.05 to 5 lux. Exposure at a low illuminance is preferable for a photosensitive material using a high-speed emulsion. The illuminance may be controlled by changing the luminous intensity of a light source or reducing light by means of various filters, or changing the distance or angle between the sensitive material and the light source. The exposure time can be reduced by using weak light in the initial stage of exposure and then stronger light.

Irradiation of light is preferably performed after a sensitive material has been immersed in a developer or its pre-bath solution until the solution sufficiently permeates into an emulsion layer of the sensitive material. The time from the immersion into the solution to the light fogging exposure is generally 2 seconds to 2 minutes, preferably 5 seconds to 1 minute, more preferably 10 to 30 seconds.

The exposure time for fogging is generally 0.01 seconds to 2 minutes, preferably 0.1 second to 1 minute, more preferably 1 to 40 seconds.

When the nucleating agent is contained in a sensitive material, the amount is preferably $10^{-8}$ to $10^{-2}$ mole, more preferably $10^{-7}$ to $10^{-3}$ mole, per mole of silver halide.

When the nucleating agent is added to the processing solution, the usage is preferably $10^{-5}$ to $10^{-1}$ mole, more preferably $10^{-4}$ to $10^{-2}$ mole, per mole of the processing solution.

Nucleating agents usable together with the present hydrazine nucleating agent are described in line 6 on page 49 to line 2 on page 67 of the specification of Japanese Patent Laid-Open No.61-253716, and it is particularly suitable to use the compounds expressed by Formulae [N-1] and [N-2]. Preferable examples of such compounds include the compounds [N-I-1] and [N-I-10] described on pages 56 to 58 of the same specification and the compounds [N-II-1] to [N-II-12] described on pages 63 to 66 of the same specification.

Examples of a nucleation accelerator for the nucleating agent of the present invention include the compounds expressed by the formulae (II), (III), (IV), (V), (VI), (VII) and (VIII) described below.

The term "nucleation accelerator" used in the specification means a substance which has substantially no function as a nucleating agent, but accelerates the function of the nucleating agent so as to increase the maximum density of a direct positive image and/or of reducing the development time required for obtaining a constant density of a direct positive image.

Formula (II):

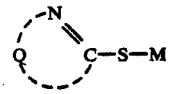

Formula (II)

wherein Q preferably denotes an atomic group necessary for forming a 5- or 6-member heterocyclic ring comprising at least one of carbon, nitrogen, oxygen, sulfur and selenium atoms. This heterocyclic ring may be condensed with an aromatic carbon ring or an aromatic heterocyclic ring.

Examples of heterocyclic rings include tetrazole, triazole, imidazole, thiadiazole, oxadiazole, selenadiazole, oxazole, thiazole, benzoxazole, benzothiazole, benzimidazole, pyrimidine, tetraazaindene, triazaindene and pentaazaindene rings.

M denotes a hydrogen atom, an alkali metal atom such as a sodium or potassium atom; an ammonium group such as a trimethylammonium group or a dimethylbenzylammonium group; or a group which can form M=H or an alkali metal atom under an alkali condition such as an acetyl group, a cyanoethyl group or a methanesulfonylethyl group.

The heterocyclic rings may be substituted by a nitro group; a halogen atom such as a chlorine atom or a bromine atom; a mercapto group; a cyano group; a substituted or unsubstituted alkyl group such as a methyl, ethyl, propyl, t-butyl, methoxyethyl, methylthioethyl, dimethylaminoethyl, morpholinoethyl, dimethylaminoethylthioethyl, diethylaminoethyl, dimethylaminopropyl, dipropylaminoethyl, dimethylaminohexyl, methylthiomethyl, methoxyethoxyethoxyethyl, trimethylammonioethyl, or cyanoethyl group; an aryl group such as a phenyl, 4-methanesulfonamindophenyl, 4-methylphenyl, 3-methoxyphenyl, 4-dimethylaminophenyl, 3,4-dichlorophenyl or naphthyl group; an alkenyl group such as an aryl group; aralkyl group such as a benzyl, 4-methylbenzyl, phenetyl, or 4-methoxybenzyl group; alkoxy group such as a methoxy, ethoxy, methoxyethoxy, methylthioethoxy or dimethylaminoethoxy group; an aryloxy group such as a phenoxy or 4-methoxyphenoxy group; an alkylthio group such as a methylthio, ethylthio, propylthio, methylthioethyl, dimethylaminoethylthio, methoxyethylthio, morpholinoethylthioethylthio, imidazolylethylthio, 2-pyridylmethylthio or diethylaminoethylthio group; an arylthio group such as a phenylthio or 4-dimethylaminophenylthio group; a heterocyclic oxy group such as a 2-pyridyloxy or 2-imidazolyloxy group; a heterocyclic thio group such as a 2-benzothiazolylthio or 4-pyrazolylthio group; a sulfonyl group such as a methanesulfonyl, ethanesulfonyl, p-toluenesulfonyl, methoxyethylsulfonyl or dimethylaminoethylsulfonyl group; a carbamoyl group such as an unsubstituted carbamoyl, methylcarbamoyl, dimethylaminoethylcarbamoyl, methoxyethylcarbamoyl, morpholinoethylcarbamoyl, methylthioethylcarbamoyl or phenylcarbamoyl group; a sulfamoyl group such as an unsubstituted sulfamoyl, methylsulfamoyl, imidazolylethylsulfamoyl or phenylsulfamoyl group; a carbonamido group such as an acetoamido, benzamido, methoxypropionamido or dimethylaminopropionamido group; a sulfonamido group such as a methanesulfonamido, benzenesulfonamido or p-toluenesulfonamido group; an acyloxy group such as an acetyloxy or benzoyloxy group; a sulfonyloxy group such as a methanesulfonyloxy group; an ureido group such as an unsubstituted ureido group, methylureido, ethylureido, methoxyethylureido, dimethylaminopropylureido, methylthioethylureido, morpholinoethylureido or phenylureido group; a thioureido group such as an unsubstituted thioureido, methylthioureido or methoxyethylthioureido group; an acyl group such as an acetyl, benzoyl or 4-methoxybenzoyl group; a heterocyclic group such as a 1-morpholino, 1-piperidino, 2-pyridyl, 4-pyridyl, 2-thienyl, 2-pyrazolyl, 2-imidazolyl, 2-tetrahydrofuryl or tetrahydrothienyl group; an oxycarbonyl group such as a methoxycarbonyl, phenoxycarbonyl, methoxyethoxycarbonyl, methylthioethoxycarbonyl, methoxyethoxyethoxyethoxycarbonyl, dimethylaminoethoxycarbonyl or morpholinoethoxycarbonyl group; an oxycarbonylamino group such as a methoxycarbonylamino, phenoxycarbonylamino or 2-ethylhexyloxycarbonylamino group; an amino group such as an unsubstituted amino, dimethylamino, methoxyethylamino or anilino group; a carboxylic acid or a salt thereof; a sulfonic acid or a salt thereof; or a hydroxyl group. However, it is preferable that each of the heterocyclic rings is not substituted by a carboxylic acid or its salt, a sulfonic acid or its salt or a hydroxyl group, from the viewpoint of the effect of accelerating nucleation.

Formula (III):

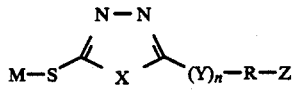

Formula (III)

wherein

M denotes the same as Formula (II);

X denotes an oxygen, sulfur or selenium atom;

Y denotes —S—,

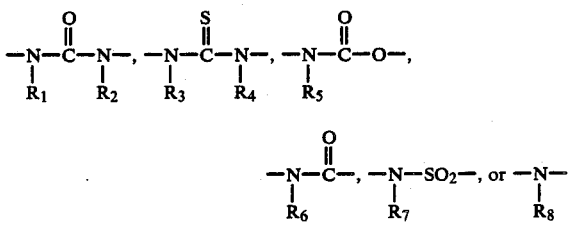

(wherein $R_1$, $R_2$, $R_3$, $R_4$, $R_5$, $R_6$, $R_7$ and $R_8$ each denotes a hydrogen atom; a substituted or unsubstituted alkyl group such as a methyl, ethyl, propyl or 2-dimethylaminoethyl group; a substituted or unsubstituted aryl group such as a phenyl or 2-methylphenyl group; a substituted or unsubstituted alkenyl group such as a propenyl or 1-methylvinyl group; or a substituted or unsubstituted aralkyl group such as a benzyl or phenethyl group);

R denotes a straight or branched chain alkylene group such as a methylene, ethylene, propylene, butylene, hexylene or 1-methylethylene; a straight or branched chain alkenylene group such as a vinylene or 1-methylvinylene; a straight or branched chain aralkylene group such as a benzylidene group; or an arylene group such as a phenylene or naphthylene group; and these groups may be further substituted;

Z denotes a hydrogen atom; a halogen atom such as a chlorine or bromine atom; a nitro group; a cyano group; a substituted or unsubstituted amino group (including salts thereof) such as an amino group, a hydrochloride thereof, a methylamino group, a dimethylamino group, a hydrochloride thereof, a dibutylamino group, a dipropylamino group, or an N-dimethylaminoethyl-N-methylamino group; a quaternary ammonio group such as a trimethylammonio or dimethylbenzylammonio group; an alkoxy group such as a methoxy, ethoxy or 2-methoxyethoxy group; an aryloxy group such as a phenoxy group; an alkylthio group such as a methylthio, butylthio or 3-dimethylaminopropylthio group; arylthio group such as a phenylthio group; a heterocyclic oxy group such as a 2-pyridyloxy or 2-imidazolyloxy group; a heterocyclic thio group such as a 2-benzthiazolylthio or 4-pyrazolylthio group; a sulfonyl group such as a methanesulfonyl, ethanesulfonyl or p-toluenesulfonyl group; a carbamoyl group such as an unsubstituted carbamoyl or methylcarbamoyl group; a sulfamoyl group such as an unsubstituted sulfamoyl or methylsulfamoyl group; a carbonamido group such as an acetoamido or benzamido group; a sulfonamido group such as a methanesulfonamido or benzenesulfonamido; an acyloxy group such as an acetyloxy or benzoyloxy group; an ureido group such as an unsubstituted ureido, methylureido or ethylureido group; a thioureido group such as an unsubstituted thioureido methylthioureido group; a sulfonyloxy group such as a methanesulfonyloxy or p-toluenesulfonyloxy group; a heterocyclic group such as a 1-morpholino, 1-piperidino, 2-pyridyl, 4-pyridyl, 2-thienyl, 1-pyrazolyl, 1-imidazolyl, 2-tetrahydrofuryl or 2-tetrahydrothienyl group; an oxycarbonyl group such as a methoxycarbonyl, methylthiomethoxycarbonyl or phenoxycarbonyl group; an oxysulfonyl group such as a methoxysulfonyl, phenoxysulfonyl or ethoxysulfonyl group; an oxycarbonylamino group such as an ethoxycarbonylamino, phenoxycarbonylamino or 4-dimethylaminophenoxycarbonylamino group; or a mercapto group; and n denotes 0 or 1.

Formula (IV):

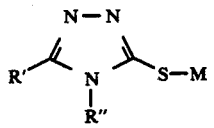

Formula (IV)

wherein R′ denotes a hydrogen atom, a halogen atom such as a chlorine or bromine atom, a nitro group, a mercapto group, an unsubstituted amino group or a group $-(Y)_n-R-Z$; and R″ denotes a hydrogen atom, an unsubstituted amino group or $13(Y')_m-R-Z$ (wherein Y′ denotes

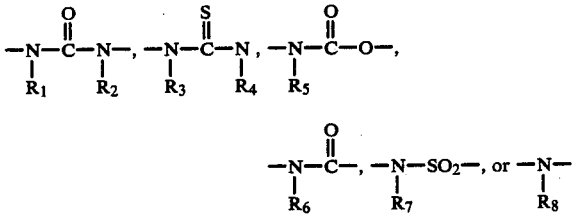

and m denotes 0 or 1);

M, R, Z, Y, n, $R_1$, $R_2$, $R_3$, $R_4$, $R_5$, $R_6$, $R_7$ and $R_8$ denoting the same as those of Formula (III).

The compound expressed by Formula (III) is preferably a compound in which X is a sulfur atom, Y is —S— and R is a straight or branched chain alkylene group, from the viewpoint of the effect of accelerating nucleation.

A compound expressed by Formula (IV) is preferably a compound in which R′ is a hydrogen atom or $-(Y)_m-R-Z$, Y is —S—, m=0 and R is a straight or branched chain alkylene group or arylene group.

Formula (V):

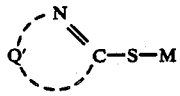

wherein

Q′ denotes triazaindene, tetrazaindene or pentazaindene; and

M denotes the same as that of Formula (II).

These heterocyclic rings may be substituted by the substituents which are applied to the heterocyclic ring of Formula (II), but it is preferable from the viewpoint of the effect of accelerating nucleation that they are not substituted by hydroxyl groups, carboxyl groups or salts thereof or sulfonic acid groups or salts thereof.

Preferable examples of heterocyclic rings of the compounds used in the present invention include s-triazolo[4,3-a]pyrimidine, s-triazolo[1,5-a]pyrimidine, s-triazolo[4,3-c]pyrimidine and s-triazolo[4,3-b]pyridazine.

Formula (VI):

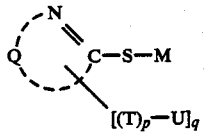

wherein T denotes a bivalent connecting group comprising an atom selected from carbon, nitrogen, oxygen and sulfur atoms or atomic group consisting thereof, such as

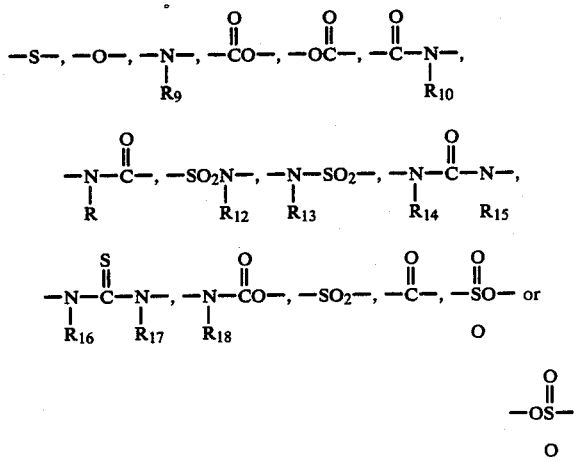

(wherein $R_9$, $R_{10}$, $R_{11}$, $R_{12}$, $R_{13}$, $R_{14}$, $R_{15}$, $R_{16}$, $R_{17}$, and $R_{18}$ each denotes a hydrogen atom, a substituted or unsubstituted alkyl group such as a methyl, ethyl, propyl or n-butyl group, a substituted or unsubstituted aryl group such as a phenyl or 2-methylphenyl group, a substituted or unsubstituted alkenyl group such as a propenyl or 1-methylvinyl group, or a substituted or unsubstituted aralkyl group such as a benzyl or phenethyl group);

U denotes an organic group containing at least one of thioether, amino (including salts), ammonium, ether and heterocyclic groups (including salts). Examples of the organic group include groups which contain the above-described groups combined with groups selected from substituted or unsubstituted alkyl groups, alkenyl groups, aralkyl groups and aryl groups and groups comprising combinations of these groups, such as a dimethylaminoethyl group, an aminoethyl group, a diethylaminoethyl group, a dibutylaminoethyl group, a hydrochloride of a dimethylaminopropyl group, or a dimethylaminoethylthioethyl, 4-dimethylaminophenyl, 4-dimethylaminobenzyl, methylthioethyl, ethylthiopropyl, 4-methylthio-3-cyanophenyl, methylthiomethyl, trimethylammonioethyl, methoxyethyl, methoxyethoxyethoxyethyl, methoxyethylthioethyl, 3,4-dimethoxyphenyl, 3-chloro-4-methoxyphenyl, morpholinoethyl, 1-imidazolylethyl, morpholinoethylthioethyl, pyrrolidinoethyl, piperidinopropyl, 2-pyridylmethyl, 2-(1-imidazolyl)-ethylthioethyl, pyrazolylethyl, triazolylethyl or methoxyethoxyethoxyethoxycarbonylaminoethyl group;

p denotes 0 or 1; and q denotes 1 or 2.

These heterocyclic rings may be substituted by the substituents which are used in the heterocyclic ring of Formula (II).

Preferable examples of a ring expressed by Q include tetrazole, triazole, imidazole, thiadiazole, oxadiazole, tetrazaindene, triazaindene and pentazaindene rings.

G and M each denotes the same as that of Formula (II).

Formula (VII):

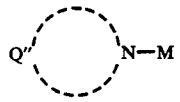

wherein Q'' denotes an atomic group necessary for forming a 5- or 6-member heterocyclic ring which can produce imimo silver, and M denotes the same as that of Formula (II).

Examples of the ring expressed by Q'' include indazole, benzimidazole, benzotriazole, benzoxazole, benzthiazole, imidazole, thiazole, oxazole, triazole, tetrazole, tetraazaindene, triazaindene, diazaindene, pyrazole and indole rings, but tetraazaindene and benzotraizole rings are not preferable from the viewpoint of the effect of accelerating nucleation.

These heterocyclic rings may be substituted by the substituents which are used in the heterocyclic ring of Formula (II) or by hydroxyl groups, but it is preferable from the viewpoint of the effect of accelerating nucleation that they are not substituted by carboxyl groups or salts thereof or sulfonic acid groups or salts thereof.

Formula (VIII):

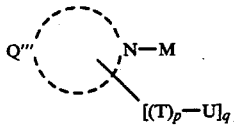

wherein Q''' denotes an atomic group necessary for forming a 5- or 6-member heterocyclic ring which can produce imino silver, M denotes the same as that of Formula (II), and $[(T)_p-U]_q$ denotes the same as that of Formula (VI).

Examples of the heterocyclic ring expressed by Q include indazole, benzimidazole, benzotriazole, benzoxazole, benzthiazole, imidazole, thiazole, oxazole, triazole, tetrazole, tetraazaindene, triazaindene, diazaindene, pyrazole and indole rings.

These heterocyclic rings may be substituted by the substituents which are used in the heterocyclic ring of Formula (II).

Examples of the compounds expressed by Formulae (II), (III), (IV), (V), (VI), (VII) and (VIII) of the present invention are given below, but the compounds of the present invention are not limited to these compounds.

①

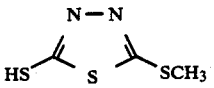

-continued

②

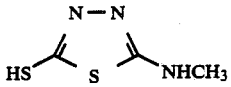

③

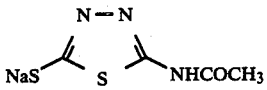

④

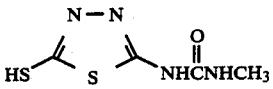

⑤

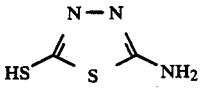

⑥

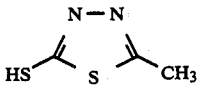

⑦

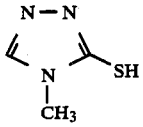

⑧

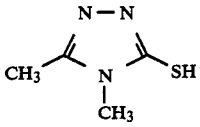

⑨

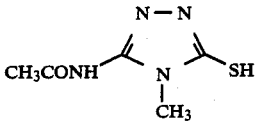

⑩

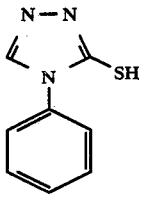

⑪

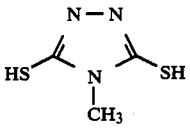

⑫

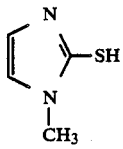

-continued
(13)
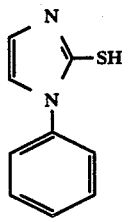
(14)
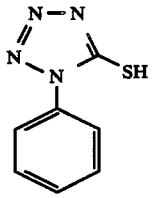
(15)
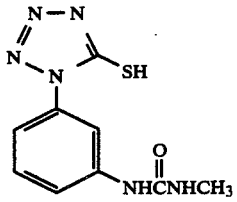
(16)
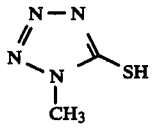
(17)
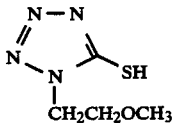
(18)
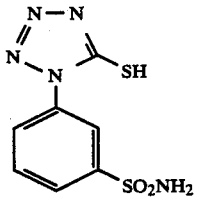
(19)
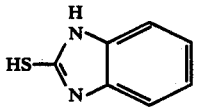
(20)
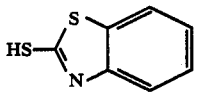
(21)
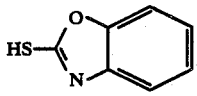
(22)
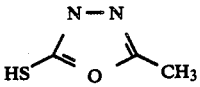
-continued
(23)
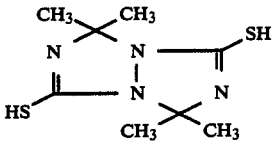
(24)
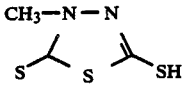
(25)
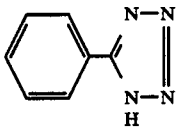
(26)
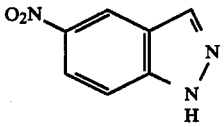
(27)
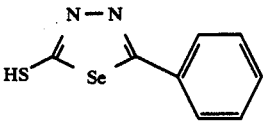
(28)
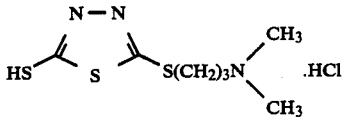
(29)
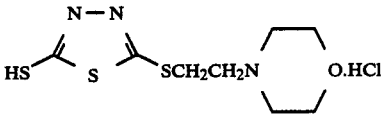
(30)
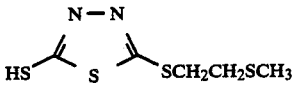
(31)
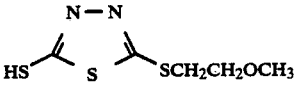
(32)
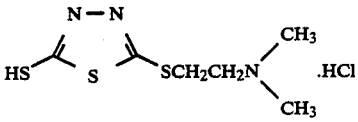
(33)
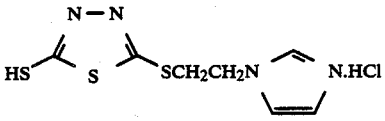
(34)
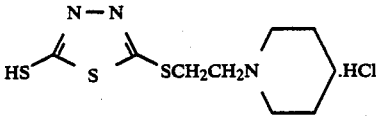

-continued
(35)
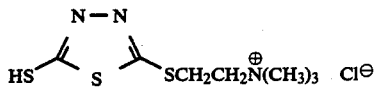
(36)
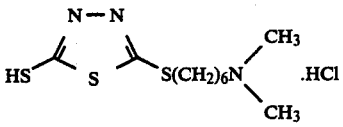
(37)
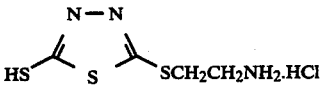
(38)
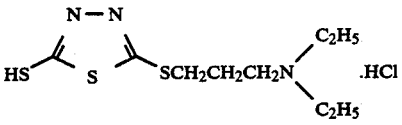
(39)
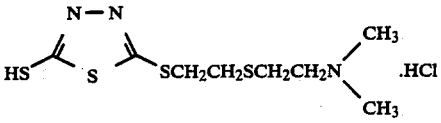
(40)
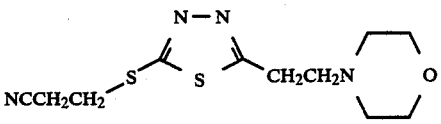
(41)
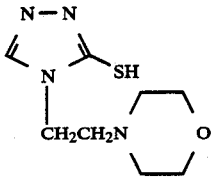
(42)
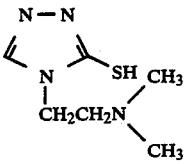
(43)
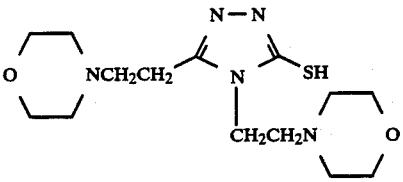
(44)
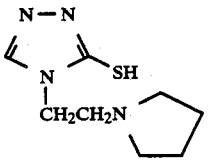
-continued
(45)
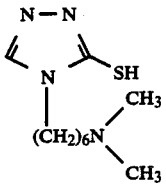
(46)
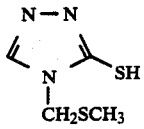
(47)
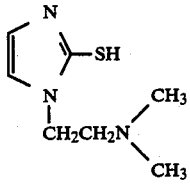
(48)
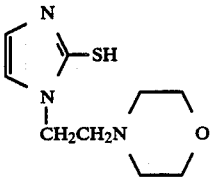
(49)
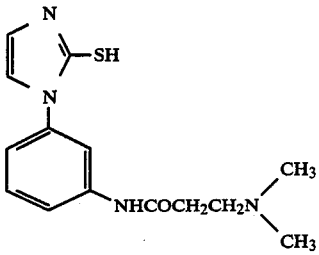
(50)
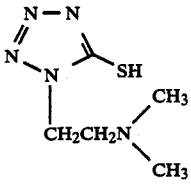
(51)
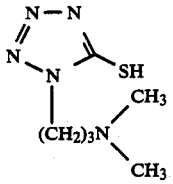
(52)
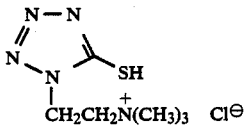

-continued (53)

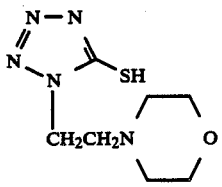

(54)

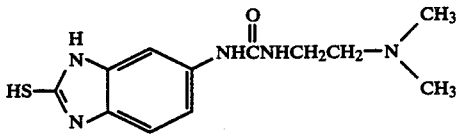

(55)

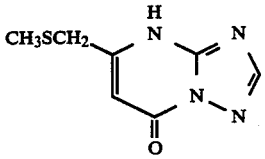

(56)

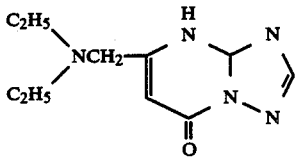

(57)

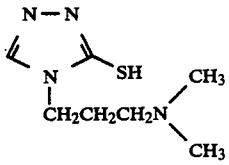

(58)

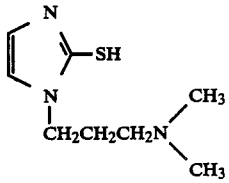

(59)

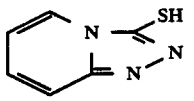

(60)

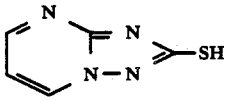

(61)

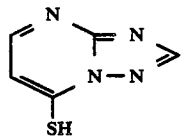

(62)

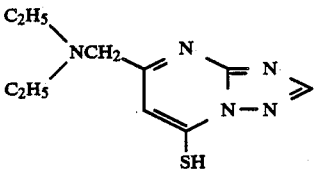

-continued (63)

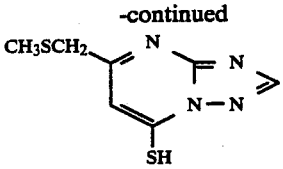

(64)

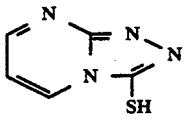

(65)

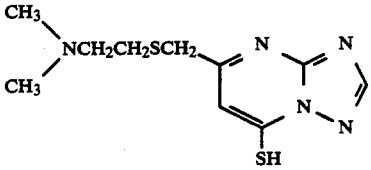

The nucleating agent used in the present invention can be synthesized in accordance with the method described in Berichte der Deutschen Chemischen Gesellschaft, 28, 77 (1985); Japanese Patent Laid-Open No. 50-37436 or 51-3231; U.S. Pat. Nos. 3,295,976 and 3,376,310; Berichte der Deutschen Chemischen Gesellschaft, 22, 568 (1889) or 29. 2483 (1896); Journal of Chemical Society, 1932, 1806; Journal of the American Chemical Society, 71, 4000 (1949); U.S. Pat. Nos. 2,585,388 and 2,541,924; Advances in Heterocyclic Chemistry, 9, 165 (1968); Organic Synthesis, IV, 569 (1963); Journal of the American Chemical Society, 45, 2390 (1923); Chemischen Berichte, 9, 465 (1876); Japanese Patent Publication No. 40-28496; Japanese Patent Laid-Open No. 50-89034; U.S. Pat. Nos. 3,106,467, 3,420,670, 2,271,229, 3,137,578, 3,148,066, 3,511,663, 3,060,028, 3,271,154, 3,251,691, 3,598,599 and 3,148,066; Japanese Patent Publication No. 43-4135; U.S. Pat. Nos. 3,615,616, 3,420,664, 3,071,465, 2,444,605, 2,444,606, 2,444,607 and 2,935,404; The Journal of Organic Chemistry, 24, 779–801 (1959) or 25, 861–866 (1960); U.S. Pat. Nos. 2,152,460, 2,713,541, 2,743,181, 2,743,180, 2,887,378, 2,935,404, 2,444,609, 2,933,388, 2,891,862, 2,861,076 and 2,735,769, and the representative examples described below.

The nucleating agent can be contained in a sensitive material or its processing solution, but the nucleating agent is preferably contained in an internal latent image-type silver halide emulsion or other hydrophilic colloidal layers (intermediate or protective layer) among a sensitive material, and preferably in a silver halide emulsion or a layer adjacent thereto.

The addition amount of the nucleating agent is preferably $10^{-6}$ to $10^{-2}$ mole, more preferably $10^{-5}$ to $10^{-2}$ mole, per mole of silver halide.

When the nucleating agent is added to the processing solution, i.e. a developer or its pre-bath, the addition amount of the nucleating agent is preferably $10^{-8}$ to $10^{-3}$ mole, more preferably $10^{-7}$ to $10^{-4}$ mole, per liter of the solution.

In addition, two kinds of nucleating agents can be used as a combination thereof.

The previously unfogged internal latent image-type emulsion usable in the present invention is described in line 14 on page 28 to line 2 on page 31 of the specification of Japanese Patent Application No. 61-253716 filed on Oct. 27, 1986 (Applicant: Fuji Photo Film Co., Ltd.), and the silver halide grains usable in the present invention are described in line 3 on page 31 to line 11 on page 32 of the same specification. Silver chlorobromide or silver chloride which contains substantially no silver iodide is particularly preferable. The sentence "contain substantially no silver iodide" means that the silver halide contains silver iodide in an amount of 5 mol % or less, preferably 1 mol % or less, more preferably contains no silver iodide at all.

The total amount of AgCl is 10 to 100 mol %, preferably 20 to 80 mol %, more preferably 25 to 60 mol %.

The average grain size (the average is obtained on the basis of the projected area by considering, when a grain has a spherical form or a form near a sphere, the grain diameter, and when a grain has a cubic form, the length of an edge, as a grain size) of the silver halide grains is generally 0.1 to 2.0μm, preferably 0.15 to 1.4 μm, more preferably 0.20 to 1.1 μm. The distribution of grain sizes may be narrow or wide, but the grains of the silver halide emulsion usable in the present invention preferably has a narrow distribution of grain sizes, a so-called "mono-dispersion", in which 90% or more, particularly 95% or more, of all the grains have sizes within the range of the average grain size ±40% (more preferably ±30%, the most preferably ±20% in terms of the number or weight of the grains, in order to improve the graininess and the sharpness of an image. In addition, two or more monodisperse silver halide emulsions having different grain sizes or a plurality of emulsions having the same grain size and different sensitivities can be mixed in the same layer or applied in multiple separate layers in emulsion layers having substantially the same color sensitivity, so that a sensitive material satisfies a target gradation. It is also possible to use two or more polydisperse silver halide emulsions or monodisperse and polydisperse emulsions in combination by mixing them or in a multi-layer form.

The silver halide grains usable in the present invention may have any crystal forms, for example, a regular crystal form such as a cubic, octahedral, dodecahedral, or tetradecahedral form, an irregular form such as a spherical form, or a composite form thereof.

The photographic emulsion usable in the present invention may be subjected to spectral sensitization by a conventional method using a photographic sensitizing dye. Particularly useful dyes are those belonging to cyanine dyes, merocyanine dyes, or composite merocyanine dyes, and these dyes can be used singly or as a combination thereof, or used together with a supersensitizer.

Examples of dyes and methods of using dyes are described in detail in, for example, Research Disclosure, 17643 (December, 1987) IV.

The photographic emulsion usable in the present invention can contain benzenethiosulfonic acids, benzenesulfinic acids, or thiocarbonyl compounds for the purpose of preventing fogging during the production process, the storage, or photographic processing of a sensitive material, or for the purpose of stabilizing the photographic performance.

Examples of an anti-fogging agent or stabilizer and methods of using them are described in detail in, for example, U.S. Pat. Nos.3,954,474 and 3,982,947; Japanese Patent Publication No. 52-28660; Research Disclosure, 17643 (December, 1978) IV A to VI M; and E. J. Birr, "Stabilization of Photographic Silver Halide Emulsion", Focal Press (1974).

Various couplers can be used in the formations of direct positive color images. Useful couplers are compounds which couples with the oxidant of an aromatic primary amine color developer to preferably produce or release a substantially nondiffusible dye, and which are themselves substantially nondiffusible compounds. Examples of an useful color coupler include naphthol or phenol compounds, pyrazolone or pyrazoloazole compounds, and cyclic or heterocyclic ketomethylene compounds. Examples of cyan, magenta and yellow couplers which can be used in the present invention include compounds described in "Research Disclosure" No.17643 (December, 1978) P25 VII-D and No.18717 (November, 1979), patent application No.61-32462, pp 298–373, and the patents cited therein.

Of these couplers, a representative yellow coupler usable in the present invention is an oxygen-linked coupling-off or nitrogen-linked coupling-off type of 2-equivalent yellow coupler. An α-pivaloyl acetoanilide coupler is particularly excellent in fastness, particularly in lightfastness, of a colored dye, and an α-benzolyl acetoanilide coupler is preferable because a high color density is obtained.

Examples of a 5-pyrazolone magenta coupler preferably usable in the present invention include magenta couplers of 5-pyrazolone type which is substituted by an arylamino or acylamino group at the 3-position thereof (particularly, a sulfur-linked coupling-off type of 2-equivalent coupler).

A pyrazoloazole coupler is more preferable, and pyrazolo[5,1-c][1,2,4]triazoles described in U.S. Pat. No. 3,725,067 are particularly preferable. However, from the viewpoint of less secondary adsorption of a yellow colored dye and of a good lightfastness, imidazo[1,2-b]pyrazoles described in U.S. Pat. No.4,500,630 are more preferable and pyrazolo[1,4-b][1,2,4]triazoles described in U.S. Pat. No. 4,450,654 are particularly preferable.

Preferable examples of a cyan coupler usable in the present invention include naphthol and phenol couplers described in U.S. Pat. Nos.2,474,293 and 4,052,212, and cyan couplers of phenol type which are described in U.S. Pat. No. 3,772,002 and which have alkyl groups larger than an ethyl group at the meta-position of the phenol nucleus. 2,5-diacylamino-substituted phenol couplers are also preferable from the viewpoint of the fastness of a color image.

Particularly preferable examples of yellow, magenta and cyan couplers include the compounds described in pages 35 to 51 of patent application No.61-169523 (filed on June 18, 1986; Applicant: Fuji Photo Film Co., Ltd.) and the compounds described below.

-continued
(M-12)
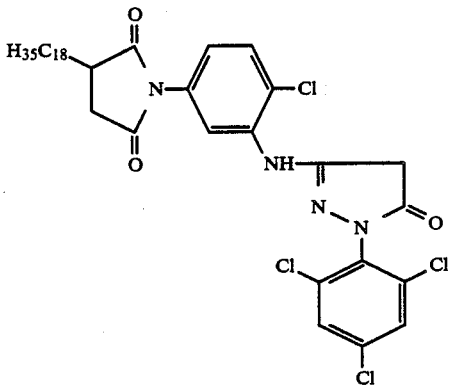
(M-13)
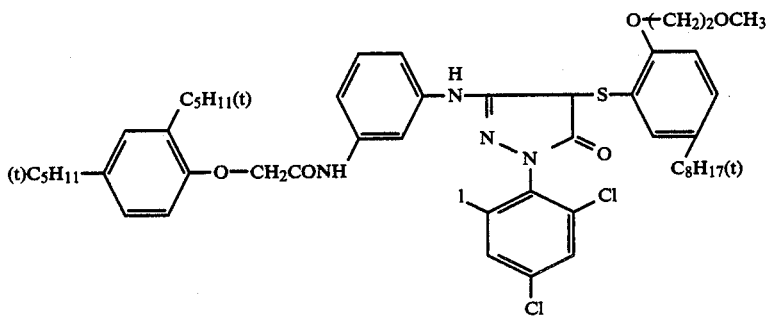
(M-14)
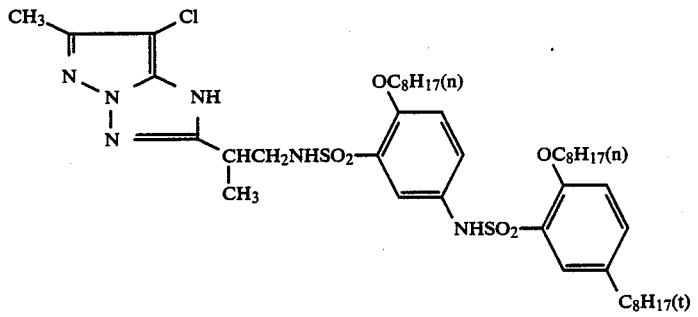
(M-15)
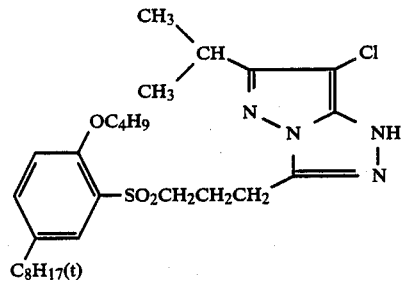
Yellow coupler
(Y-9)
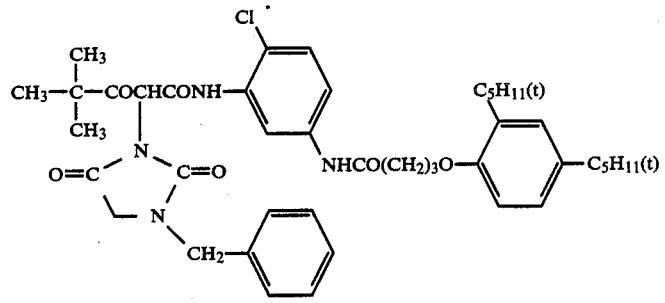

-continued (Y-10)

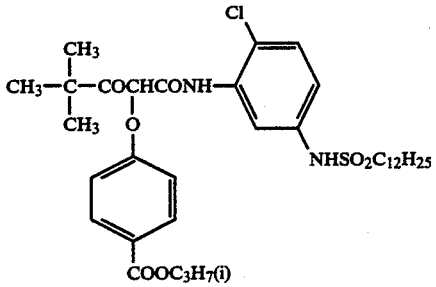

(Y-11)

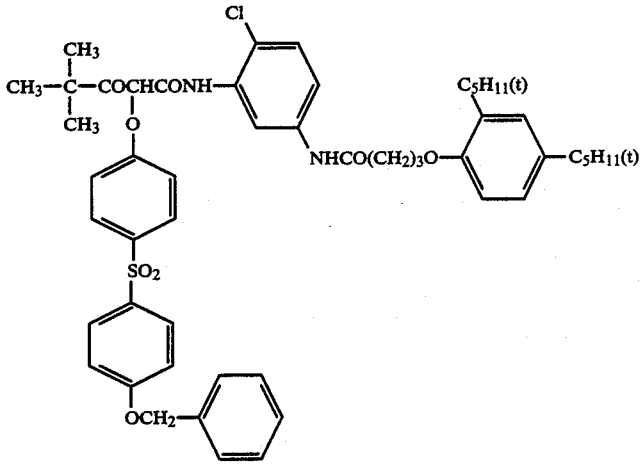

Cyan coupler (C-10)

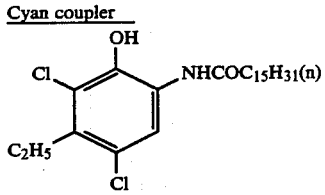

(C-11)

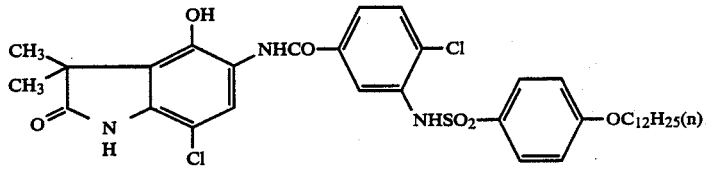

The color developer usable in the development of the present sensitive material is described in line 4 on page 71 to line 9 on page 72 of the specification of patent application No. 61-253716, and p-phenylenediamine compounds are particularly preferable as an aromatic primary amine color developer. Examples of the color developer include 3-methyl-4-amino-N-ethyl-(β-methanesulfonamidoethyl)aniline, 3-methyl-4-amino-N-ethyl-N-(β-hydroxyethyl)aniline, 3-methyl-4-amino-N-ethyl-N-methoxyethylaniline, and salts thereof such as sulfates and hydrochlorides. The pH of the developer used in the present invention is generally 9.5 to 12.5, preferably 9.7 to 12.0, more preferably 9.8 to 11.5. In addition, it is preferable that the color developer of the present invention contains substantially no benzyl alcohol.

The photographic emulsion layer is generally subjected to a bleaching process after the color development. The bleaching process may be performed by a one-bath bleach-fixing method in which the bleaching and fixing are performed at the same time, or separately performed. The bleaching process may be also performed by a method in which the bleach-fixing is performed after bleaching or after fixing, in order to accelerate the processing. An iron complex salt of aminopolycarboxylic acid is generally used as a bleaching agent in the bleaching or bleach-fixing solution of the present invention. The various compounds described on pages 22 to 30 of the specification of patent application No. 61-32462 can be used as an additive to be used in the bleaching or bleach-fixing solution of the present invention. Water washing and/or stabilization are performed after the process of desilvering (bleach-fixing or fixing). Softened water can be preferably used as a washing water or a stabilization solution. Examples of a softening method include the method described in the specification of patent application No.61-131632, which method uses an ion exchange resin or a reverse osmosis equipment. The softening is preferably performed in accordance with the method described in the above specification.

The various compounds described in pages 30 to 36 of the specification of patent application No.61-32462 can be used as an additive to be used in the processes of water washing and stabilization.

It is preferable that the amount of a replenisher in each of the processes is small. The amount of a replenisher is preferably 0.1 to 50 times, more preferably 3 to 30 times, the amount of a solution carried from the pre-bath per unit area of a sensitive material.

(EXAMPLE)

The present invention will be described in detail below with reference to examples.

Synthetic Example A

(Synthesis of nucleating agent)

Synthetic example 1. Synthesis of Compound 1

2.5 g of 2-(4-aminophenyl)-1-formylhydrazine was dissolved in 10 g of N,N-dimethylformamide under an atmosphere of nitrogen, and 2.1 g of triethylamine was then added to the obtained solution. The resultant mixture was cooled to −5° C. A solution obtained by dissolving 5.8 g of 4-(2,4-di- tert-pentylphenoxy)-1-butylsulfonyl chloride in 10 g of acetonitrile, was added dropwisely to the mixture. During the addition, the mixture was agitated under cooling so that the temperature did not exceed 0° C. After the mixture had been agitated at 0° C. for 1 hour, it was poured into ice water and extracted with ethyl acetate. The organic layer was washed with saturated salt water, dried with anhydrous sodium sulfate, and then filtered. The filtrate was concentrated, and the concentrate was purified by using silica gel column chromatography (developing solvent: ethyl acetate/chloroform=2/1 (vol/vol)) to obtain the object compound (yield: 2.7 g, oily substance).

Synthetic example 2. Synthesis of Compound 10

2-(1) Synthesis of 2-[4-(3-nitrobenzenesulfonamido)-phenyl]-1-formylhydrazine 1 l of N,N-dimethylacetoamide, 880 g of acetonitrile, and 285 g of triethylamine were added to and dissolved in 426 g of 2-(4-aminophenyl)-1-formylhydrazine under an atmosphere of nitrogen. The solution was cooled to −5° C., and 625 g of meta-nitrobenzenesulfonyl chloride was gradually added to the solution. During the addition, the mixture was agitated under cooling so that the temperature did not exceed −5° C. The resultant mixture was cooled at a temperature below −5° C. for 1.5 hours, then the temperature thereof was raised to a room temperature. Extraction was performed with 12 l of ethyl acetate and 12 l of saturated salt water. The organic layer was separated and then concentrated to 6 l. 3 l of n-hexane was added to the concentrate, and the obtained mixture was agitated at a room temperature for 30 minutes. The produced crystals were filtered off and washed with 500 g of ethyl acetate.

Yield: 680 g.

Melting point: 191°–193° C.

2-(2) Synthesis of 2-[4(3-aminobenzenesulfonamido)-phenyl]-1-formylhydrazine 680 g of iron powder, 68 g of ammonium chloride, 6.5 l of isopropanol, and 2.2 l of water were mixed, and the obtained mixture was heated under agitation on a vapor bath. 680 g of the nitro compound obtained in 2-(1) was added to the mixture, followed by reflux for 1.5 hours. Insoluble substances were then filtered off, and the filtrate was concentrated under reduced pressure. Water was added to the concentrate, and the produced crystals were filtered off and washed with 1 l of isopropanol.

Yield: 535 g

Melting point: 155°–156° C.

2-(3) Synthesis of 2-[4(3-phenoxycarbonylaminobenzenesulfonamido)-phenyl]-1-formylhydrazine 450 g of the amino compound obtained in 2-(2) was dissolved in 2.8 l of N,N-dimethylacetoamide under an atmosphere of nitrogen, and the solution was then cooled to −5° C. 120 g of pyridine was added to the solution, and 230 g of phenyl chloroformate was added dropwisely to the obtained mixture. During the addition, the mixture was agitated under cooling so that the temperature did not exceed −5° C. After the mixture had been agitated at a temperature below −5° C. for 1 hour, 20 l of saturated salt water was added dropwisely to the reaction solution, followed by agitation for 30 minutes The prodcued crystals were filtered off and then washed with 2 l of water.

Yield: 611 g.

Melting point: 195°–197° C.

2-(4) Synthesis of Compound 10

32 g of 3-(2,4-di-tert-pentylphenoxy)-1-propylamine and 15 g of imidazole were dissolved in 30 g of acetonitrile under an atmosphere of nitrogen, and the solution was heated to 50° C. A solution obtained by dissolving 42.6 g of the urethane compound obtained in 2-(3) in 40 g of N,N-dimethylacetoamide was added dropwisely to the solution, and the mixture was heated under agitation at 50° C. for 1.5 hours. After the mixture had been cooled to 30° C., it was poured into a mixture of 1 l of 0.5 mole/l hydrochloric acid and 1 l of ethyl acetate. The organic layer was separated and then concentrated. The product was recrystallized by a mixed solvent of ethyl acetate with n-hexane (vol/vol =2/5).

Yield: 33.6 g.

Melting point: 118°–121° C. (softening).

Synthetic example 3. Synthesis of Compound 37

2.5 g of 2-(4-aminophenyl)-1-acetylhydrazine was dissolved in 10 g of N,N-dimethylformamide under an atmosphere of nitrogen, and 2.1 g of triethylamine was then added to the solution, followed by cooling to −5° C. A solution obtained by dissolving 5.8 g of 4-(2,4-di-tert-pentylphenoxy)-1-butylsulfonyl chloride in 10 g of acetonitrile was added dropwisely to the obtained mixture. During the addition, the mixture was agitated under cooling so that the temperature did not exceed 0° C. After the mixture had been cooled at 0° C. for 1 hour, it was poured into ice water. Extraction was performed with ethyl acetate, and the organic layer was washed with saturated salt water, dried with anhydrous sodium sulfate, and then filtered. The filtrate was then concentrated, and the concentrate was purified by separation using silica gel column chromatography (developing solvent: ethyl acetate/chloroform=2/1 (vol/vol)) to obtain the object compound (yield: 3.2 g, oily substance).

Synthetic example 4. Synthesis of Compound 38

10.6 g of 2-(3-aminophenyl)-1-formylhydrazine was dissolved in 30 g of N,N-dimethylformamide under an atmosphere of nitrogen, and 8.2 g of triethylamine was added to the solution, followed by cooling to −5° C. A solution obtained by dissolving 11.3 g of 4-(2,4-di-tert-pentylphenoxy)-1-butylsulfonyl chloride in 10 g of acetonitrile was added dropwisely to the obtained mixture. During the addition, the mixture was agitated under cooling so that the temperature did not exceed 0° C. After the mixture had been cooled at 0° C. for 1 hour, it was poured into ice water. Extraction was performed with ethyl acetate. The organic layer was washed with saturated salt water, dried with anhydrous sodium sulfate, and then filtered. The filtrate was concentrated, and the concentrate was purified by using silica gel column chromatography (developing solvent: ethyl acetate/chloroform=2/1 (vol/vol)) to obtain the object compound (yield: 12.2 g, solid substance).

Synthetic example 5. Synthesis of Compound 2

5-(1) Synthesis of 1-(2-chloro-4-nitrophenyl)hydrazine 59 g of hydrazine hydrate was dissolved in 712 ml of acetonitrile at room temperature under an atmosphere of nitrogen. A solution obtained by dissolving 46.3 g of 1,2-dichloro-4-nitrobenzene in 71 g of acetonitrile was added dropwisely to the obtained solution. After the addition had been completed, the obtained mixture was subjected to reflux by heat for 4 hours, and the reaction solution was concentrated. 500 g of water was added to the concentrate, and the produced crystals were filtered off. 200 g of acetonitrile was then added to the crystals, and the obtained mixture was subjected to reflux by heat for 30 minutes and then cooled with ice to room temperature. The produced crystals were filtered off (yield: 27 g).

5-(2) Synthesis of
2-(2-chloro-4-nitrophenyl)-1-formylhydrazine 27 g of the hydrazine compound obtained in 5-(1) was dissolved in 160 g of acetonitrile under an atmosphere of nitrogen, and 14 g of formic acid was then added dropwisely to the solution. After reflux by heat for 2 hours, the obtained mixture was cooled with ice, and the produced crystals were filtered off and then washed with acetonitrile (yield: 20.3 g).

5-(3) Synthesis of
2-(4-amino-2-chlorophenyl)-1-formylhydrazine 19.5 g of the nitro compound obtained in 5-(2), 20 g of iron powder, 2 g of ammonium chloride, 400 g of isopropanol and 20 g of water were mixed under an atmosphere of nitrogen, and the mixture was then agitated under reflux on a vapor bath for 2 hours. Insoluble substances were filtered off while being heated, and the filtrate was concentrated to about 200 g under reduced pressure. The concentrate was then cooled with ice, and the produced crystals were filtered off and washed with 200 g of isopropanol (yield: 11.0 g).

5-(4) Synthesis of Compound 2

5.55 g of 2-(4-amino-2-chlorophenyl)-1-formylhydrazine was dissolved in 30 g of N,N-dimethylformamide under an atmosphere of nitrogen, and 3.03 g of triethylamine was then added to the solution, followed by cooling to −5° C. A solution obtained by dissolving 11.8 g of 4-(2,4-di-tert-pentylphenoxy)-1-butylsulfonyl chloride in 10 g of acetonitrile was added dropwisely to the obtained mixture. During the addition, the mxiture was agitated under cooling so that the temperature did not exceed 0° C. After the mixture had been agitated at 0° C. for 1 hour, it was poured into ice water. Extraction was performed with ethyl acetate. The organic layer was washed with saturated salt water, dried with anhydrous sodium sulfate, and then filtered. The filtrate was concentrated, and the concentrate was then purified by using silica gel column chromatography (developing solvent: ethyl acetate/chloroform=1/2 (vol/vol)) to obtain the object compound.

Yield: 7.0 g.

Melting point: 157°-159° C.

Synthetic example 6. Synthesis of Compound 36

6-(1) Synthesis of
2-chloro-1-diethylsulfamoyl-5-nitrobenzene 7.6 g of 2-chloro-5-nitrophenylsulfonyl chloride was dissolved in 50 g of acetone, and the obtained solution was then cooled to −10° C. A solution obtained by dissolving 3.03 g of triethylamine and 2.2 g of diethylamine in 20 g of acetonitrile was added dropwisely to the obtained solution. During the addition, the mixture was agitated under cooling so that the temperature did not exceed 0° C. The temperature was gradually raised to room temperature, and the mixture was poured into a dilute solution of hydrochloric acid at pH of about 2. The produced crystals were filtered off and washed with water (yield: 7.8 g).

6-(2) Synthesis of
1-(2-diethylsulfamoyl-4-nitrophenyl)-hydrazine

The chloro compound obtained in 6-(1) was dissolved in 90 g of methanol, and the solution was refluxed while being heated. A solution obtained by dissolving 6.2 l of hydrazine hydrate in 30 g of ethanol was added dropwisely to the solution. After the obtained mixture had been refluxed for 4 hours, the reaction solution was concentrated to obtain the object compound (yield: 7.8 g).

6-(3) Synthesis of
2-(2-diethylsulfamoyl-4-nitrophenyl)-1-formylhydrazine

The hydrazine compound obtained in 6-(2) was dissolved in 25 g of acetonitrile under an atmosphere of nitrogen, and 2 g of formic acid was then added dropwisely to the solution. After the mixture had been refluxed for 5 hours while being heated, the mixture was concentrated under reduced pressure, and 100 g of water was added to the concentrate, followed by agitation at room temperature for 1 hour. The produced crystals were filtered off and then recrystallized by ethanol (yield: 4.0 g).

6-(4) Synthesis of
2-(4-amino-diethylsulfamoylphenyl)-1-formylhydrazine 10 g of the nitro compound obtained in 6-(3) was dissolved in 210 g of ethanol and 90 g of water under an atmosphere of nitrogen, and a solution obtained by dissolving 27 g of hydrosulfite in 120 g of water was added dropwisely to the obtained solution. After the mixture had been agitated at room temperature for 30 minutes, it was agitated at 60° C. for 15 minutes. Insoluble substances were removed by filtration, and the filtrate was concentrated under reduced pressure. 100 g of water was added to the concentrate, and the produced crystals were filtered off and then recrystallized by ethanol (yield: 3.7 g).

6-(5) Synthesis of Compound 36

1.7 g of the amino compound obtained in 6-(4) was dissolved in 17 g of acetonitrile under an atmosphere of nitrogen, and the solution was then refluxed under heating. A solution obtained by dissolving 2.8 g of 4-(2,4-di-tert-pentylphenoxy)-1-butylsulfonyl chloride in 2.8 g of acetonitrile was added dropwisely to the solution. After the mixture had been refluxed under heating for 1 hour, it was poured into 200 g of water. The supernatant was removed, and n-hexane was added to the residue so as to solidify it. The N-hexane supernatant was removed, and the residue was then washed with ether to obtain the object compound.

Yield: 1.4 g.

Melting point: 169°-171° C.

Synthetic example 7. Synthesis of Compound 21

7-(1) Synthesis of 2-[4-(3-nitrobenzenesulfonamido)-phenyl]-1-formylhydrazine 1 l of N,N-dimethylacetoamide, 880 g of acetonitrile and 285 g of triethylamine were dissolved in 426 g of 2-(4-aminophenyl)-1-formylhydrazine under an atmosphere of nitrogen, and the mixture was cooled to −5° C. Then, 625 g of nitrobenzenesulfonyl chloride was gradually added to the mixture. During the addition, the mixture was agitated under cooling so that the temperature was below −5° C. After the mixture had been agitated at a temperature below −5° C. for 1.5 hours, the temperature was raised to room temperature. Extraction was performed with 12 l of ethyl acetate and 12 l of saturated salt water, and an organic layer was separated, then concentrated to 6 l. 3 l of n-hexane was added to the concentrate, and the obtained mixture was agitated at room temperature for 30 minutes. The produced crystals were filtered off and then washed with 500 ml of ethyl acetate.

Yield: 680 g.

Melting point: 191°-193° C.

7-(2) Synthesis of 2-[4-(3-aminobenzenesulfonamido)-phenyl]-1-formylhydrazine 680 g of iron powder, 68 g of ammonium chloride, 6.5 l of isopropanol, and 2.2 l of water were mixed with each other, and the obtained mixture was agitated under heating on a vapor bath. 680 g of the nitro compound obtained in 7-(1) was added to the mixture, followed by reflux for 1.5 hours. Insoluble substances were filtered off, and the filtrate was then concentrated under reduced pressure. Water was added to the concentrate. The produced crystals were filtered and washed with 1 l of isopropanol.

Yield: 535 g.

Melting point: 155°-156° C.

7-(3) Synthesis of 2-[4-(3-phenoxycarbonylaminobenzenesulfonamido)-phenyl]-1-formylhydrazine 450 g of the amino compound obtained in 7-(2) was dissolved in 2.8 l of N,N-dimethylacetoamide under an atmosphere of nitrogen, and the obtained solution was cooled to −5° C. 120 g of pyridine was added to the obtained mixture, and 230 g of phenyl chloroformate was then added dropwisely thereto. During the addition, the mixture was agitated under cooling so that the temperature was below −5° C. After the mixture had been agitated at −5° C. for 1 hour, 20 l of saturated salt water was added to the reaction solution, followed by agitation for 30 minutes. The produced crystals were filtered and then washed w)th 2 l of water.

Yield: 611 g.

Melting point: 195°-197° C.

7-(4) Synthesis of Compound 21

5.93 g of 1-(3-aminophenyl)-5-mercaptotetrazole hydrochloride and 7.03 g of imidazole were dissolved in 30 g of acetonitrile under an atmosphere of nitrogen, and the obtained solution was heated to 65° C. A solution obtained by dissolving 10 g of urethane compound obtained in 7-(3) in 58 g of N,N-dimethylacetoamide was added dropwisely to the solution, the the obtained mixture was agitated under heating at 65° C. for 1.5 hours. After the mixture had been cooled to 30° C., extraction was performed with 240 g of ethyl acetate and 240 g of water, and a water layer was poured into a dilute solution of hydrochloric acid. The produced crystals were filtered and washed with water.

Yield: 8.2 g.

Melting point: 205°-209° C.

Synthetic example 8. Synthesis of Compound 39

8-(1) Synthesis of 2-[4-(2-chloro-5-nitrobenzenesulfonamido)phenyl]-1-formylhydrazine 90 g of N,N-dimethylacetoamide, 76 9 of acetonitrile, and 19 g of pyridine were dissolved in 35.4 g of 2-(4-chloroamionophenyl)-1-formylhydrazine under an atmosphere of nitrogen, and the obtained solution was cooled to −5° C. Then, 59.9 g of 2-chloro-5-nitrobenzenesulfonyl chloride was gradually added to the solution. During the addition, the mixture was agitated under cooling so that the temperature was below −5° C. After the mixture had been agitated at −5° C. for 1.5 hours, the temperature was raised to room temperature, and the mixture was then poured into 1 l of saturated salt water. The produced crystals were filtered and washed with water (yield: 63 g).

8-(2) Synthesis of 2-[4-(5-amino-2-chlorobenzenesulfonamido)phenyl]-1-formylhydrazine 30.1 g of iron powder, 4.5 g of ammonium chloride, 930 g of dioxane, and 400 g of water were mixed with each other, and the obtained mixture was agitated under heating on a vapor bath. 50 g of the nitro compound obtained in 8-(1) was then added to the mixture, followed by reflux for 1.5 hours. Insoluble substances were filtered off, and the filtrate was concentrated under reduced pressure. Extraction was then performed with ethyl acetate and saturated salt water, and an organic layer was concentrated under reduced pressure (yield: 43 g, oily substance).

8-(3) Synthesis of 1-(3-phenoxyamidophenyl)-5-mercaptotetrazole 390.5 g of 1-(3-aminophenyl)-5-mercaptotetrazole hydrochloride was dissolved in 800 g of N,N-dimethylacetoamide under an atmosphere of nitrogen, and 302 g of pyridine was then added dropwisely to the obtained solution. After the obtained mixture had been cooled to a temperature below 0° C., 235 g of phenyl chloroformate was added dropwisely to the mixture. During the addition, the mixture was agitated under cooling so that the temperature was below 0° C. After the mixture had been agitated at a temperature below 0° C. for 30 minutes, the temperature was raised to room temperature, and the mixture was then agitated for 3 hours. After the mixture had been cooled to a temperature below 10° C., 500 g of isopropanol and 5 l of water were added thereto, followed by agitation for 1 hour. The produced crystals were filtered and washed with water.

Yield: 495 g.

Melting point: 190°-191° C.

8-(4) Synthesis of Compound 39

6.5 g of the amino compound obtained in 8-(2) and 5.4 g of the urethane compound obtained in 8-(3) were dissolved in 35 g of N,N-dimethylacetoamide under an atmosphere of nitrogen, and 6.1 g of N-methylmorpholine was then added to the obtained solution. After the obtained mixture had been agitated at 50° C. for 7 hours, the mixture was cooled to room temperature and then poured into 330 g of dilute hydrochloric acid. The produced crystals were filtered and washed with water.

Yield: 6.2 g.

Melting point: 160°-165° C. (decomposition).

Synthetic example 9. Synthesis of Compound 17

10 g of N,N-dimethylformamide was added dropwisely to a solution containing 10 g of sodium 3-(5-mercaptotetrazoyl)phenylsulfonate and 7 g of thionyl chloride while agitation under cooling with ice. The temperature was then gradually raised to room temperature, and the obtained mixture was agitated for 2 hours. Excess thionyl chloride was distilled off from the reaction solution under reduced pressure. The obtained residue was poured into ice water, and extraction was then performed twice with chloroform. The extract was dried with anhydrous magnesium sulfate and then concentrated under reduced pressure, to obtain 3.5 g of a colorless oily substance of 3-(5-mercaptotetrazoyl)-phenylsufonyl chloride (yield: 36%).

1.4 g of pyridine was then added to 10 g of a N,N-dimethylformamide solution containing 2.2 g of 1-formyl-2-(4-aminophenyl) hydrazine under cooling with ice under a stream of nitrogen. 5 g of an acetonitrile solution containing 3.5 g of 3-(5-mercaptotetrazoyl)-phenylsulfonyl chloride was then added dropwisely to the obtained solution, and the obtained mixture was agitated for 1 hour under cooling with ice. The reaction solution was poured into an aqueous solution containing 100 g of water and 3 g of hydrochloric acid, and the separated crystals were filtered off. The obtained crystals were recrystallized by isopropyl alcohol to obtain 4.4 g of 1- 3[-4-(2-formylhydazino)phenyl]sulfamoyl phenyl-5-mercaptotetrazole.

Yield: 77%.

Melting point: 192° C. (decomposition).

Synthetic Example B (Synthetic example of a nucleation accelerator)

Synthetic example 1. Method of synthesizing Compound 28

7.5 g of 2,5-dimercapto-1,3,4-thiadiazole, 7.9 g of 3-dimethylaminopropyl chloride hydrochloride and 4 g of pyridine were added to 60 ml of n-butanol, and the obtained mixture was heated under reflux for 2 hours. The reaction solution was cooled with ice, and the separated crystals were filtered off and then recrystallized by ethanol.

Yield: 11 g. 20 Melting point: 149°-152° C.

Synthetic example 2. Method of synthesizing Compond 37

7.5 g of 2,5-dimercapto-1,3,4-thiadiazole, 5.8 g of 2-aminoethyl chloride hydrochloride and 4 g of pyridine were added to 60 ml of n-butanol, and the obtained mixture was heated under reflux for 2 hours. The reaction solution was cooled with ice, and the separated crystals were filtered off and then recrystallized by methanol/water.

Yield: 7.1 g.

Melting point: 228°-229° C. (decomposition).

Synthetic example 3. Method of synthesizing Compound 32

7.5 g of 2,5-dimercapto-1,3,4-thiadiazole, 7.3 g of 2-dimethylaminoethyl chloride hydrochloride and 4 g of pyridine were added to 60 ml on n-butanol, and the obtained mixture was heated under reflux for 2 hours. The reaction solution was cooled with ice, and the separated crystals were filtered off and then recrystallized by ethanol.

Yield: 7.9 g.

Melting point: 161°-163° C.

Synthetic example 4. Method of synthesizing Compound 33

15.0 g of 2,5-dimercapto-1,3,4-thiadizole, 20.0 g of 1-(2-chloroethyl)imidazole hydrochloride and 9.5 g of pyridine were added 100 ml of acetonitrile, and the obtained mixture was heated under reflux for 4 hours. The reaction solution was cooled, and the separated crystals were filtered off and then recrystallized from a mixed solvent of dimethylformamide with methanol, to obtain compound 33.

Yield:.

Melting point: 226°-228° C.

Synthetic example 5. Method of synthesizing Compound 54

250 ml of N,N-dimethylacetoamide was added to a mixture of 36.6 g of 5-amino-2-mercaptobenzoimidazole with 7.1 ml of pyridine, and 34.4 g phenyl chloroformate was then added dropwisely to the obtained mixture at room temperature. After the obtained mixture had been agitated at room temperature for 1.5 hours, the mixture was poured into 1.5 l of ice water to separate crystals. The obtained crystals were filtered off and then recrysyallized from acetonitrile, to obtain 47.7 g of 2-mercapto-5-phenoxycarbonylaminobenzoimidazole.

100 ml of acetonitrile was added to 8.6 g of the obtained 2-mercapto-5-phenoxycarbonylaminobenzoimidazole, and the obtained mixture was heated under reflux at 45° C.. 14.5 g of N,N-dimethylaminoethylenediamine was added dropwisely to the obtained mixture, followed by agitation at 45° C. for 1.5 hours. The separated crystals were filtered off and then recrystallized from a mixed solvent of N,N-dimethylformamide with methyl alcohol, to obtain 6.2 g of the object compound (yield: 74%).

Melting point: 240° C. (decomposition).

Synthetic example 6. Method of synthesizing Compound 30

100 ml of ethyl alcohol was added to 10.5 g of 2,5-dimercapto-1,3,4-thiadiazole, and 14 ml of a 28% sodium methoxide was then added to the obtained mixture to form a solution by heating. 7.7 ml of 2-methylthioethyl chloride was added dropwisely to the obtained solution, and the obtained mixture was refluxed for 3 hours. After the reaction, the reaction solution was cooled to room temperature by being allowed to stand and then poured into 1 1 of ice water. The separated crystals were filtered off and recrystallized from a mixed solvent of ethyl acetate with n-hexane, to obtain 10.8 g of the object compound (yield: 68.8%).

Melting point: 75°-76° C.

Synthetic example 7. Method of synthesizing Compound 41

8.6 g of 2-(N-morpholino)ethyl isothiocyanate was added dropwisely to a mixed solution of 7.5 ml of hydrazine hydrate with 30 ml of ethanol under ice cooling, and the obtained mixture was then agitated for 2 hours. The produced precitates were filtered off, and 50 ml of formic acid was added to 9.5 g of the obtained crystals, followed by reflux by heat for 8 hours. The reaction solution was distilled under reduced pressure, and the obtained residue was neutralized by an aqueous solution of 5% sodium hydroxide and then purified by column chromatography (stationary phase of alumina; developing solvent: ethyl acetate/methanol) and recrystallized by chloroform, to obtain 4.9 g of the object compound.

Melting point: 146°-147° C.

Synthetic example 8. Method of synthesizing Compound 42

6.5 g of 2-dimethylaminoethyl isothiocyanate was gradually added to a mixed solution of 7.5 ml of hydrazine hydrate with 30 ml of ethanol under ice cooling, and the obtained mixture was agitated for 3 hours. The reaction solution was poured into 100 ml of water and then extracted with chloroform. An organic layer was washed with saturated salt water, and the solvent was then distilled off under reduced pressure. 36 ml of formic acid was added to 7.2 g of the obtained residue, and the obtained mixture was heated under reflex for 8 hours. The reaction solution was distilled under reduced pressure, and the obtained residue was neutralized by an aqueous solution of 5% sodium hydroxide and then purified by column chromatography (stationary phase of alumina; developing solvent: ethyl acetate/methanol) and recrystallized by ethyl acetate/n-hexane to obtain 3.8 g of the object compound.

Melting point: 103°-104° C.

Synthetic example 9. Method of synthesizing Compound 57

7.2 g of 3-dimethylaminopropyl isothiocyanate was added dropwisely to a mixed solution of 7.5 ml of hydrazine hydrate with 30 ml of ethanol under ice cooling, and obtained mixture was agitated for 3 hours. The reaction solution was poured into 100 ml of ice water and then extracted with ether. An ether layer was washed with saturated salt water, and the solvent was then distilled off under reduced pressure. The obtained residue was neutralized by an aqueous solution of 5% sodium hydroxide, and purified by column chromatography (stationary phase of alumina; developing solvent: ethyl acetate/methanol) and recrystallized by isopropyl alcohol, to obtain 4.5 of the object compound.

Melting point: 161°-163° C.

Synthetic example 10. Method of synthesizing Compound 47

13 g of 2-dimethylaminoethyl isothiocyanate was gradually added to a solution obtained by adding 13.3 g of aminoacetaldehyde diethylacetal to 100 ml of carbon tetrachloride under ice cooling. After the obtained mixture had been agitated at room temperature for 2 hours, the solvent was distilled off under reduced pressure, and 110 ml of 35% of sulfuric acid was added to the obtained residue under ice cooling, followed by reflux by heat for 3 hours. The reaction solution was neutralized by an aqueous solution of 30% sodium hydroxide and then extracted with chloroform. An organic layer was dried with anhydrous sodium sulfate, and the solvent was then distilled off under reduced pressure. The obtained residue was recrystallized by ethyl acetate, to obtain 6.8 g of the object compound.

Melting point: 130°-131° C.

Synthetic example 11. Method of synthesizing Compound 48

17.2 g of 2-(N-morpholino)ethyl isothiocyanate was added dropwisely to a solution obtained by adding 13.3 g of aminoacetaldehyde diethylacetal to 100 ml of carbon tetrachloride under ice cooling. After the obtained mixture had been agitated at room temperature for 2.5 hours, the solvent was distilled off under reduced pressure, and 110 ml of 35% sulfuric acid was added to the obtained residue under ice cooling, followed by reflux by heat for 4 hours. The reaction solution was neutralized by an aqueous solution of 30% sodium hydroxide and then extracted with chloroform. An organic layer was dried with anhydrous sodium sulfate, and the solvent was then distilled off under reduced pressure. The obtained residue was recrystallized by isopropyl alcohol to obtain 7.5 g of the object compound.

Melting point: 154°-156° C.

Emulsions X, A nd B described below were prepared for performing the present invention.

Emulsion X

An aqueous silver nitrate solution and an aqueous potassium bromide solution were simultaneously added to an aqueous gelatin solution (pH 5.5) which was maintained at 75° C. and contained 20 mg of thioether (1,8-dihydroxy-3,6-dithiaoctane) per liter, over 5 mintues at a constant speed under well agitation while the potential of a silver electrode was maintained, so that $\frac{1}{8}$ mole of silver nitrate was added to the gelatin solution, to obtain a monodisperse spherical AgBr emulsion having an average grain size of about 0.14 μm. 20 mg of sodium thiosulfate and 20 mg of chloroauric acid (tetrahydrate), relative to 1 mole of silver halide, were each added to the obtained emulsion. The pH of the obtained mixture was adjusted to 7.5, and the mixture was chemically sensitized at 75° C. for 80 minutes under well agitation to form a core emulsion. Then, an aqueous silver nitrate solution (containing $\frac{7}{8}$ mole of silver nitrate) and an aqueous potassium bromide solution were simultaneously added to the core emulsion at the same temperature over 40 minutes under well agitation, while the potential of a silver electrode was maintained at a value at which regular octahedral grains grew, so that shells were grown to form a core/shell type of monodisperse cubic emulsion having an average grain size of about 0.3.μm. The pH of the obtained emulsion was adjusted to 6.5, and 5 mg of sodium thiosulfate and 5 mg of chloroauric acid (tetrahydrate), relative to 1 mole of silver halide, were each added to the emulsion. The obtained mixture was subjected to ripening at 75° C. for 60 minutes and then to chemical sensitization of the surfaces of the shells, to finally obtain an internal latent image-type core/shell monodisperse octahedral emulsion (Emulsion X). As a result of the measurement of the distribution of the grain sizes of Emulsion X by an electron microphotograph, the average grain size was 0.03μm, and the variation coefficient (percentage of the value obtained by dividing the statistical standard deviation by the above average grain size) was 10%.

Emulsion A

An aqueous mixed solution of potassium bromide with sodium chloride, and an aqueous silver nitrate solution were simultaneously added to an aqueous gelatin solution containing 0.5 g of 3,4-dimethyl-1,3-thiazoline-2-thione relative to 1 mole of Ag, under vigorous agitation at 55° C. over about 5 minutes, to obtain a monodisperse silver chlorobromide emulsion having an average grain size of about 0.2μm. 35 g of sodium thiosulfate and 20 mg of chloroauric acid (tetrahydrate), relative to 1 mole of silver, were added to the obtained emulsion, which mixture was then heated at 55° C. for 60 minutes to chemically sensitize it.

The thus-obtained silver chlorobromide grains were used as cores and treated for 40 minutes under the same precipitation conditions as that of the first precipitation to grow the grains so as to finally obtain a core/shell-type monodisperse silver chlorobromide emulsion having an average grain size of 0.4 μm. The variation coefficient of the grain sizes was about 10%.

3 mg of sodium thiosulfate and 3.5 mg of chloroauric acid (tetrahydrate), relative to 1 mole of silver, were added to the obtained emulsion, which was heated at 60° C. for 50 minutes to chemically sensitize the emulsion to obtain an internal latent image-type silver halide emulsion A.

Emulsion B

An aqueous potassium bromide solution and an aqueous silver nitrate solution were simultaneously added to an aqueous gelatin solution containing 0.3 g of 3,4-dimethyl-1,3-thiazoline-2-thione relative to 1 mole of Ag, under vigorous agitation at 75° C. over about 20 minutes, to obtain a monodisperse octahedral silver bromide emulsion with an average grain size of 0.4 μm. 6 mg of each of sodium thiosulfate and chloroauric acid (tetrahydrate) relative to 1 mole of silver was added to the obtained emulsion, and the obtained mixture was then chemically sensitized by heating it at 75° C. for 80 minutes. The thus-obtained silver bromide grains were used as cores and treated fo 40 minutes under the same precipitation conditions as those of the first precipitation, so that the grains were grown to finally obtain a monodisperse octahedral core/shell-type silver bromide emulsion with an average grain size of 0.7μm. 1.5 mg of each of sodium thiosulfate and chloroauric acid (tetrahydrate) relative to 1 mole of silver was added to the thus-obtained emulsion, and the obtained mixture was chemically sensitized by heating it at 60° C. for 60 minutes, to obtain an internal latent image-type silver halide emulsion B. The variation coefficient of grain sizes was about 10%.

Example 1

3,3'-diethyl-9-methylthiacarbocyanine which was a panchromatic sensitizing dye was added to the above-described emulsion X in an amount of 5 mg per mole of silver halide. Then, $1.4\times10^{-5}$ mole of each of the nucleating agents shown in Table 1 relative to 1 mole of silver halide was added to the obtained mixture. The thus-obtained mixture was applied on a polyethylene terephthalate support so that the amount of silver was 2.8 g/m$^2$. At the same time, a protection layer comprising gelatin and a hardener was applied to the emulsion layer, to form direct positive photosensitive material Nos.1 to 5 which had sensitivities even to red light.

Each of the sensitive materials was exposed to light for 0.1 second by using a 1-KW tungsten (color temperature: 2854° K.) sensitometer, through a step wedge. Then, each of the materials was developed by an automatic developing machine (Kodak Proster I Processor) using a Kodak Proster Plus processing solution (developer pH 10.7) at 38° C. for 18 seconds, and was continuously washed with water, fixed, washed with water, and dried by the same developing machine. The maximum density (Dmax) and minimum density (Dmin) of each of the direct positive images of the thus-obtained samples were measured.

The results are given in Table 1.

TABLE 1

| Sample No. | Example or control | Nucleating agent | Dmax | Dmin |
|---|---|---|---|---|
| 1 | Comparative Example | 1-Formyl-2-{4-[3-(5-mercaptotetrazole-1-yl)benzamido]phenyl} hydrazine | 2.15 | 0.08 |
| 2 | Example | (7) | 2.38 | 0.06 |
| 3 | " | (17) | 2.42 | 0.06 |
| 4 | " | (21) | 2.45 | 0.06 |
| 5 | " | (39) | 2.39 | 0.05 |

It can be seen from the results that the nucleating agents used in the present invention show high Dmax values and low Dmin values and thus have excellent properties.

EXAMPLE 2

A multi-layer color sensitive material No.A comprising the following layer construction on a paper support having the surfaces laminated with polyethylene was prepared.

TABLE 2

| | |
|---|---|
| Layer E9 | Protective layer |
| Layer E8 | Ultraviolet-absorbing layer |
| Layer E7 | Blue-sensitive emulsion layer |
| Layer E6 | Intermediate layer |
| Layer E5 | Yellow filter layer |
| Layer E4 | Intermediate layer |
| Layer E3 | Green-sensitive emulsion layer |
| Layer E2 | Intermediate layer |
| Layer E1 | Red-sensitive emulsion layer |
| | Support |
| Layer B1 | Backing layer |
| Layer B2 | Protective layer |

(Layer structure)

The composition of each of the layers is described below. The numerical values indicate the application amount in terms of g/m$^2$.

The amounts of a silver halide emulsion and colloidal silver are expressed in gram in terms of the amount of the silver. The addition amounts of the spectral sensitizing dyes are expressed in terms of a molar amount relative to I mole of silver halide.

Support

Polyethylene-laminated paper (The Layer E1 side of the polyethylene contains white pigment ($TiO_2$) and blue coloring dye (ultramarine blue)).

| | | |
|---|---|---|
| Layer E1 | | |
| Silver halide emulsion | A | 0.26 |
| Spectral sensitizing dye | (ExSS-1) | $1.0 \times 10^{-4}$ |
| Spectral sensitizing dye | (ExSS-2) | $6.1 \times 10^{-5}$ |
| Gelatin | | 1.11 |
| Cyan coupler | (ExCC-1) | 0.21 |
| Cyan coupler | (ExCC-2) | 0.26 |
| Ultraviolet radiation absorber | (ExUV-1) | 0.17 |
| Solvent | (ExS-1) | 0.23 |
| Development modifier | (ExGC-1) | 0.02 |
| Stabilizer | (ExA-1) | 0.006 |
| Nucleation accelerator | (ExZS-1) | $3.0 \times 10^{-4}$ |
| Nucleating agent | (ExZK-1) | $8.0 \times 10^{-5}$ |
| Layer E2 | | |
| Gelatin | | 1.41 |
| Inhibitor of color mixture | (ExKB-1) | 0.09 |
| Solvent | (ExS-1) | 0.10 |
| Solvent | (ExS-2) | 0.10 |
| Layer E3 | | |
| Silver halide emulsion | A | 0.23 |
| Spectral sensitizing dye | (ExSS-3) | $3.0 \times 10^{-4}$ |
| Gelatin | | 1.05 |
| Magenta coupler | (ExMC-1) | 0.16 |
| Stabilizer of color image | (ExSA-1) | 0.20 |
| Solvent | (ExS-3) | 0.25 |
| Development modifier | (ExGC-1) | 0.02 |
| Stabilizer | (ExA-1) | 0.006 |
| Nucleation accelerator | (ExZS-1) | $2.7 \times 10^{-4}$ |
| Nucleating agent | (ExZK-1) | $1.4 \times 10^{-4}$ |
| Layer E4 | | |

-continued

| | | |
|---|---|---|
| Gelatin | | 0.47 |
| Inhibitor of color mixture | (ExKB-1) | 0.03 |
| Solvent | (ExS-1) | 0.03 |
| Solvent | (ExS-2) | 0.03 |
| Layer E5 | | |
| Colloidal silver | | 0.09 |
| Gelatin | | 0.49 |
| Inhibitor of color mixture | (ExKB-1) | 0.03 |
| Solvent | (ExS-1) | 0.03 |
| Solvent | (ExS-2) | 0.03 |
| Layer E6 | | |
| The same as Layer E4 | | |
| Layer E7 | | |
| Silver halide emulsion | A | 0.40 |
| Spectral sensitizing dye | (ExSS-3) | $4.2 \times 10^{-4}$ |
| Gelatin | | 2.17 |
| Yellow coupler | (ExYC-1) | 0.51 |
| Solvent | (ExS-2) | 0.20 |
| Solvent | (ExS-4) | 0.20 |
| Development modifier | (ExGC-1) | 0.06 |
| Stabilizer | (ExA-1) | 0.001 |
| Nucleation accelerator | (ExZS-1) | $5.0 \times 10^{-4}$ |
| Nucleating agent | (ExZK-1) | $1.2 \times 10^{-5}$ |
| Layer E8 | | |
| Gelatin | | 0.54 |
| Ultraviolet radiation absorber | (ExUV-2) | 0.21 |
| Solvent | (ExS-4) | 0.08 |
| Layer E9 | | |
| Gelatin | | 1.28 |
| Acryl-modified copolymer of polyvinyl alcohol (degree of modification: 17%) | | 0.17 |
| Liquid parafin | | 0.03 |
| Latex grains of polymethyl methacrylate (average grain size: 2.8 m) | | 0.05 |
| Layer B1 | | |
| Gelatin | | 8.70 |
| Layer B2 | | |
| The same as Layer E9 | | |

A gelatin hardener ExGK-1 and a surfactant were further added to each of the layers.

Compounds used for forming the samples are as follows:

Cyan coupler (ExCC-1)

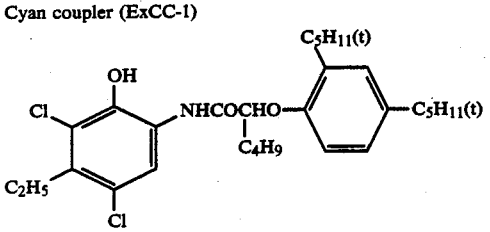

Cyan coupler (ExCC-2)

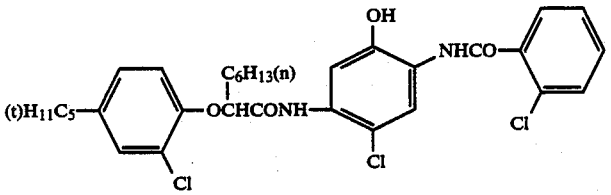

Magenta coupler (ExMC-1)

-continued
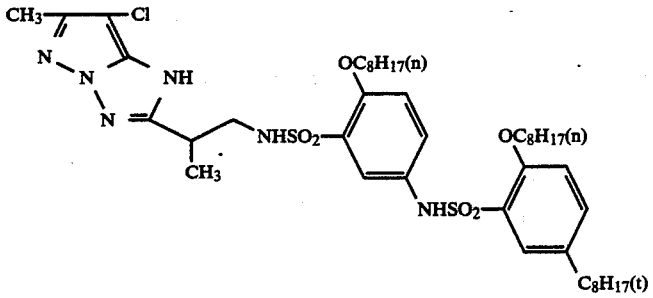
Yellow coupler (ExYC-1)
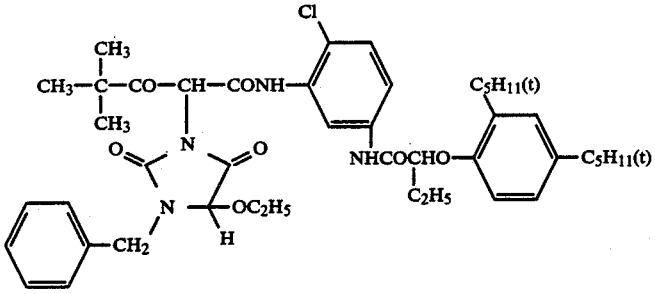
Spectral sensitizing dye (ExSS-1)
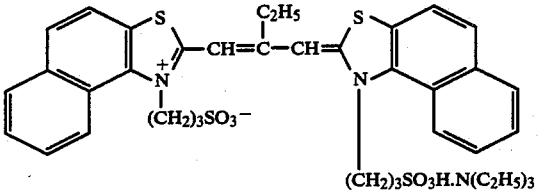
Spectral sensitizing dye (ExSS-2)
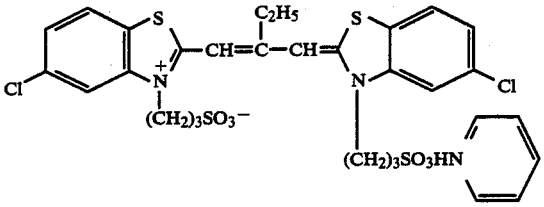
Spectral sensitizing dye (ExSS-3)
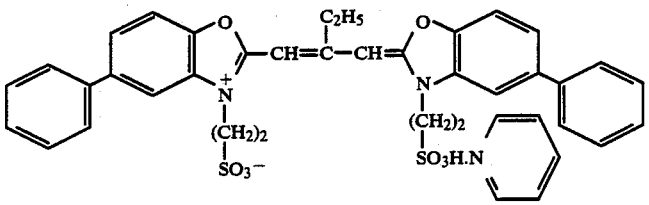
Spectral sensitizing dye (ExSS-4)
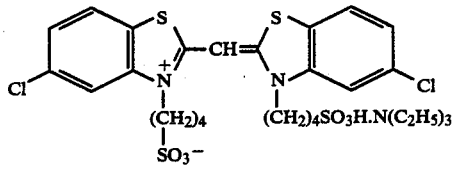
Solvent (ExS-1)

-continued

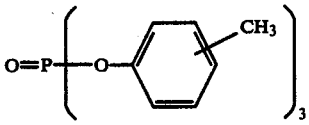

Solvent (ExS-2)

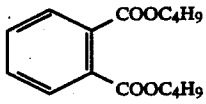

Solvent (ExS-3)
A mixture of the following compounds in a volume ratio of 1:1.

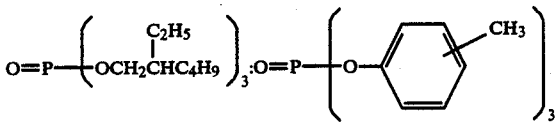

Solvent (ExS-4)
$O{=}P{-}(O{-}C_9H_{19}(iso))_3$

Ultraviolet radiation absorber (ExUV-1)

A mixture of the following compounds (1), (2) and (3) in a weight ratio of 5:8:9.

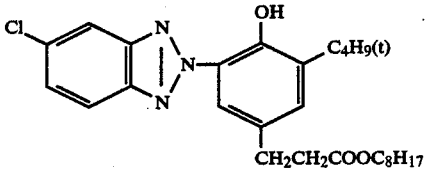

(1)

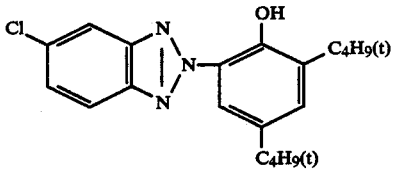

(2)

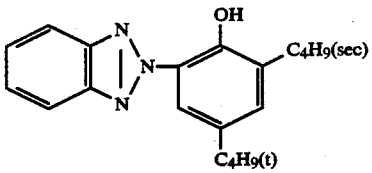

(3)

Ultraviolet radiation absorber (ExUV-2)

A mixture of the above-described compounds (1), (2), and (3) in a weight ratio of 2:9:8.

Stabilizer of color image (ExSA-1)

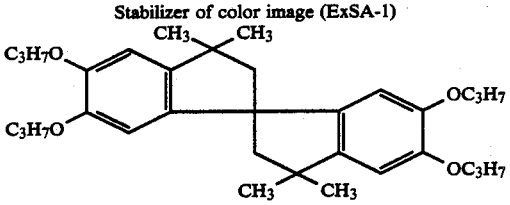

Inhibitor of color mixture (ExKB-1)

-continued

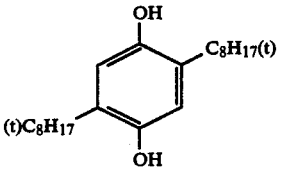

Development modifier (ExGC-1)

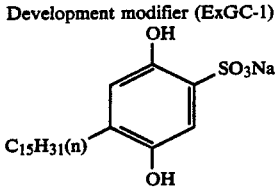

Stabilizer (ExA-1)

4-hydroxy-6-methyl-1,1,3,3a,7-tetrazaindene nucleation accelerator (ExZS-1)

2-)3-dimethylaminopropylthio)-5-mercapto-1,3,4-thiazole hydrochloride

Nucleating agent (ExZK-1)

1-formyl-2-{4-[3-(5-mercaptotetrazole-1-yl)benzamido]phenyl}hydrazine

Gelatin hardener (ExGK-1)

1-oxy-3,5-dichloro-S-triazine sodium salt

TABLE 3

| | Process A | |
|---|---|---|
| | Time | Temperature |
| Color development | 100 seconds | 38° C. |
| Bleach-fixing | 30 seconds | 38° C. |
| Water washing (1) | 30 seconds | 38° C. |
| Water washing (2) | 30 seconds | 38° C. |

A method of replenishing washing water was a so-called counter-flow method wherein washing water was first replenished into a washing water bath (2), and an overflow solution from the washing water bath (2) was introduced into a washing water bath (1).

(Color developer)

| | Mother liquor |
|---|---|
| Diethylenetriaminepentaacetic acid | 0.5 g |
| 1-Hydroxyethylidene-1,1-diphosphonate | 0.5 g |
| Diethylene glycol | 8.0 g |
| Benzyl alcohol | 10.0 g |
| Sodium bromide | 0.5 g |
| Sodium chloride | 0.7 g |
| Sodium sulfite | 2.0 g |
| N,N-diethylhydroxylamine | 3.5 g |
| 3-Methyl-4-amino-N-ethyl-N-(β-methanesulfonamidoethyl)-aniline sulfate | 6.0 g |
| Potassium carbonate | 30.0 g |
| Fluorescent brightener (stilbene type) | 1.0 g |

Pure water was added to make the total volume become 1000 ml.

pH was adjusted to 10.50 by potassium hydroxide or hydrochloric acid.

(Bleach-fixing solution)

| | Mother liquor |
|---|---|
| Ammonium thiosulfate | 110 g |
| Sodium hydrogenesulfite | 10 g |
| Ammonium iron (III) ethylenediamine-tetraacetate dihydrate | 40 g |
| Disodium ethylenediaminetetraacetate dihydrate | 5 g |
| 2-Mercapto-1,3,4-triazole | 0.5 g |

Pure water was added to make the total volume become 1000 ml.

pH was adjusted to 7.0 by ammonia water or hydrochloric acid.

(Washing water)

Pure water was used.

The term "pure water" means water obtained by removing cations except for a hydrogen ion and anions except for a hydroxide ion from tap water by an ion exchange treatment so that their concentrations are 1 ppm or less.

Multi-layer color sensitive material Nos.1 to 11 were prepared in the same manner as sample No.A except that the nucleating agent (ExZK-1) was replaced by the compounds shown in Table 4.

The thus obtained samples were subjected to wedge exposure (1/10 second, 10 CMS) and then to process A described in Table 3, and the densities of the cyan-colored images were measured. The results are shown in Table 4.

TABLE 4

| No. | Nucleating agent | Cyan image density Dmax | Dmin |
|---|---|---|---|
| 1 | Compound example-7 7 | 2.1 | 0.11 |
| 2 | Compound example-8 8 | 2.2 | 0.11 |
| 3 | Compound example-12 | 2.1 | 0.11 |
| 4 | Compound example-13 | 2.3 | 0.11 |
| 5 | Compound example-17 | 2.2 | 0.11 |
| 6 | Compound example-19 | 2.1 | 0.11 |
| 7 | Compound example-21 | 2.2 | 0.11 |
| 8 | Compound example-22 | 2.1 | 0.11 |
| 9 | Compound example-28 | 2.1 | 0.11 |
| 10 | Compound example-34 | 2.2 | 0.11 |
| 11 | Compound example-35 | 2.2 | 0.11 |
| A | ExZK-1 | 1.6 | 0.12 |

The addition amount of each of the nucleating agents was the same as that of the nucleating agent ExZK-1.

Sample Nos. 1 to 11 using the present nucleating agents advantageously exhibited higher maximum image densities (Dmax) than that of Comparative Example No.A. The magenta and yellow image densities of these samples showed the similar results to the above-described results.

EXAMPLE 3

Example 2 was repeated except that Emulsion B was used in place of Emulsion A, the nucleating agents shown in Table 5 were used, and the time of color development in process A was 120 seconds.

TABLE 5

| No. | Nucleating agent | Cyan image density Dmax | Dmin |
|---|---|---|---|
| 1 | Compound example-21 | 2.1 | 0.12 |
| 2 | Compound example-22 | 2.1 | 0.12 |
| 3 | Compound example-29 | 2.1 | 0.12 |
| 4 | Compound example-30 | 2.1 | 0.12 |
| 5 | Compound example-39 | 2.0 | 0.12 |
| A | ExZK-1 | 1.8 | 0.12 |

The addition amount of each of the nucleating agents was the same as that of ExZk-1.

Sample Nos.1 to 5 using the present nucleating agents advantageously exhibited higher maximum image densities (Dmax) than that of Comparative Example No.B. However, they exhibited effects which were not so remarkable as those obtained by Emulsion A.

EXAMPLE 4

Example 2 was repeated except that the nucleation accelerator (ExZS-1) was removed and the time of color development in process A was 120 seconds. The same results were obtained.

EXAMPLE 5

Example 2 was repeated except that process A was replaced by process B described below. The same results were obtained.

EXAMPLE 6

Example 2 was repeated except that the following process C was used in place of Process A. The same results were obtained.

EXAMPLE 7

The sensitive material of Example 2 was allowed to stand for 3 days at 45° C. and high humidity of 80% RH (incubation), exposed and then processed in the same manner as in Example 2. Comparisons were made between the incubated samples and unincubated samples, with respect to the maximum cyan image densities (Dmax). Sample Nos.1 to 11 containing the present nucleating agents showed smaller reductions in the maximum densities than that of Comparative Example No.A.

Process B

| | Process B Time | Temperature |
|---|---|---|
| Color development | 100 seconds | 40° C. |
| Bleach-fixing | 40 seconds | 38° C. |
| Water washing (1) | 30 seconds | 38° C. |

-continued

| Process B | Time | Temperature |
|---|---|---|
| Water washing (2) | 30 seconds | 38° C. |

(Color developer)

| | Mother liquor |
|---|---|
| Disodium ethylenediaminetetraacetate dihydrate | 1.0 g |
| Sodium sulfite | 2.0 g |
| Sodium bromide | 0.3 g |
| Hydroxylamine sulfate | 2.6 g |
| Sodium chloride | 3.2 g |
| 3-Methyl-4-amino-N-ethyl-N-hydroxyethylaniline | 7.0 g |
| Potassium carbonate | 30.0 g |
| Fluorescent brightener (stilbene type) | 1.0 g |

Pure water was added to make the total volume become 1000 ml.

pH was adjusted to 10.50 by potassium hydroxide or hydrochloride acid.

(Bleach-fixing solution)

| | Mother liquor |
|---|---|
| Ammonium thiosulfate | 110 g |
| Sodium hydrogenesulfite | 10 g |
| Ammonium iron (III) ethylenediaminetetraacetate dihydrate | 40 g |
| Disodium ethylenediaminetetraacetate dihydrate | 5 g |

Pure water was added to make the total volume become 1000 ml.

pH was adjusted to 6.5 by ammonia water or hydrochloric acid.

(Washing water)

The same as process A.

Process C

| | Time | Temperature |
|---|---|---|
| Color development*(1) | 90 seconds | 36° C. |
| Bleach-fixing | 40 seconds | 36° C. |
| Stablization (1) | 40 seconds | 36° C. |
| Stabilization (2) | 40 seconds | 36° C. |
| Drying | 40 seconds | 70° C. |

*(1)Color development was performed under light fogging for 15 seconds (0.6 CMS 4200 g) from the start of the development.

(Color developer)

| | Mother liquor |
|---|---|
| Hydroxyethyl iminodiacetic acid | 0.5 g |
| Monoethylene glycol | 9.0 g |
| Benzyl alcohol | 9.0 g |
| Monoethanolamine | 2.5 g |
| Sodium bromide | 0.3 g |
| Sodium chloride | 3.0 g |
| N,N-diethylhydroxylamine | 6.3 g |
| 3-Methyl-4-amino-N-ethyl-N-(β-methanesulfonamidoethyl)-aniline sulfate | 3.0 g |
| 3-Methyl-4-amino-N-ethyl-N-hydroxyethylaniline | 5.0 g |

-continued

| | Mother liquor |
|---|---|
| Potassium carbonate | 30.0 g |
| Fluorescent brightener (stilbene type) | 1.0 g |

Pure water was added to make the total volume become 1000 ml.

pH was adjusted to 10.30 by potassium hydroxide or hydrochloric acid.

(Bleach-fixing solution)

| | Mother liquor |
|---|---|
| Ammonium thiosulfate | 110 g |
| Sodium hydrogenesulfite | 10 g |
| Ammonium iron (III) diethylenetriamine-pentaacetate | 80 g |
| Diethylenetriaminepentaacetic acid | 5 g |
| 2-Mercapto-5-amino-1,3,4 thiadiazole | 0.3 g |

Pure water was added to make the total volume become 1000 ml.

pH was adjusted to 6.80 by ammonia water or hydrochloric acid.

(Stabilizing solution)

| | Mother liquor |
|---|---|
| 1-Hydroxyethylidene-1,1-diphosphonate | 2.7 g |
| o-Phenylphenol | 0.2 g |
| Potassium chloride | 2.5 g |
| Bismuth chloride | 1.0 g |
| Zinc chloride | 0.25 g |
| Sodium sulfite | 0.3 g |
| Ammonium sulfate | 4.5 g |
| Fluorescent brightener | 0.5 g |

Pure water was added to make the total volume become 1000 ml.

pH was adjusted to 7.2 by potassium hydroxide or hydrochloride acid.

EXAMPLE 8

Example 6 was repeated except that the cyan couplers (ExCC-1 and ExCC-2), the magenta coupler (ExMC-1), and the yellow coupler (ExYC-1) were replaced by the following cyan coupler, magenta coupler, and yellow coupler respectively. The same results were obtained.

(Cyan coupler)

A mixture of the compounds described below in a molar ratio of 1:1.

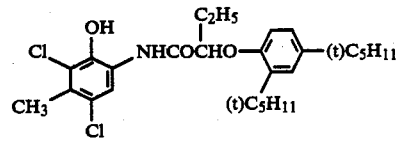

-continued

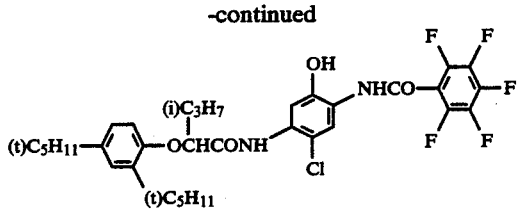

(Magenta coupler) M-12

(Yellow coupler)

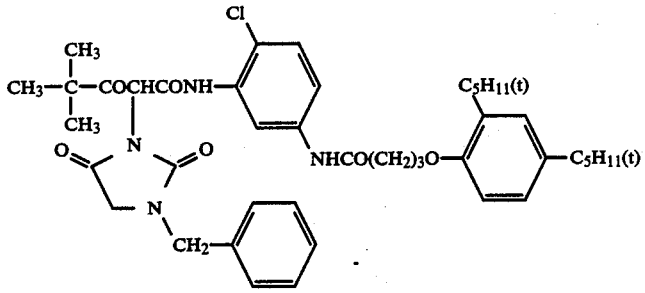

EXAMPLE 9

Example 8 was repeated except that the Emulsions E, F and G described in Examples 1, 2 and 3 of Japanese Patent Laid-Open No. 61-2148 were used. The same results were obtained.

EXAMPLE 10

Example 9 was repeated except that process C was changed to Process A. The same results were obtained.

EXAMPLE 11

3,3'-diethyl-9-methyl thiacarbocyanine (a panchromatic sensitizing dye) was added to Emulsion X in an amount of 5 mg per mole of silver halide, and each of the compounds shown in Table 6 was then added as a nucleating agent and nucleation accelerator to the obtained mixture. The thus-obtained mixture was then applied to a support of polyethylene terephthalate so that the amount of silver was 2.8 g/m$^2$. At the same time, a protective layer comprising gelatin and a hardener was applied to the emulsion layer to form each of direct positive photosensitive materials 101 to 106 which had sensitivities even to red light.

Each of the thus-obtained photosensitive materials was exposed to light for 0.1 seconds by a sensitometer using a 1-KW tungsten lamp (color temperature: 2854° K.) through a step wedge.

Each of the materials was then develped at 38° C. for 18 seconds by an automatic developing machine (Kodak Proster I Processor) using a processing solution (Kodak Proster Plus: pH of the developer: 10.7), and then washed with water, fixed, washed with water, and dried by the same developing machine. The maximum density (Dmax) and minimum density (Dmin) of a direct positive image of each of the thus-obtained samples were measured. The results are shown in Table 6.

TABLE 6

| Sample No. | Nucleating agent*1 | Nucleation accelerator*2 | Dmax | Dmin |
|---|---|---|---|---|
| 101 | 1-formyl-2-{4-[3-(5-mercapto-tetrazole-1-yl)-benzamido}phenyl) hydrazine | | 1.83 | 0.11 |
| 102 | 1-formyl-2-{4-[3-(5-mercapto-tetrazole-1-yl)-benzamido}phenyl) hydrazine | 28 | 2.31 | 0.09 |
| 103 | (7) | 28 | 2.52 | 0.07 |
| 104 | (21) | 36 | 2.60 | 0.06 |
| 105 | (28) | 7 | 2.58 | 0.06 |
| 106 | (35) | 64 | 2.63 | 0.07 |

*1Addition amount: 1.4 × 10$^{-5}$ mole per mole of silver halide
*2Addition amount: 1.0 × 10$^{-3}$ mole per mole of silver halide It can be seen from the results of Table 6 that Sample Nos. 103 to 106 exhibit high values of Dmax and low values of Dmin and thus have excellent properties.

EXAMPLE 12

A multi-layer color sensitive material Sample No. 201 comprising the layer structure shown in Table 2 of Example 2 was prepared except that the nucleation accelerator was not used.

Samples Nos.202 to 214 were formed wherein the nucleating agents shown in Table 7 was used in place of the nucleating agent ExZK-1 used in Layers E1, E3 and E7, and the nucleation accelerators shown in Table 7.

TABLE 7

| Sample No. | Nucleating agents and nucleation accelerators added to Layers E1, E3 and E7: Nucleating agent*(1) added to Layers E1, E3 and E7 | Nucleation accelerator*(2) added to Layers E1, E3 and E7 |
|---|---|---|
| 202 | Same as Sample 201 | 28 |
| 203 | Same as Sample 201 | 38 |
| 204 | Same as Sample 201 | 41 |
| 205 | (18) | 17 |
| 206 | (18) | 23 |
| 207 | (21) | 28 |
| 208 | (21) | 36 |
| 209 | (21) | 7 |
| 210 | (29) | 64 |
| 211 | (29) | 36 |
| 212 | (39) | 53 |
| 213 | (39) | 59 |
| 214 | (39) | 30 |

*(1)The addition amount of each of the nucleating agents was the same as that of ExZk-1 added to Layers E1, E3 and E7 of Sample No. 201.
*(2)The addition amount of each of the nucleation accelerators was 3.0 × 10$^{-4}$, 2.7 × 10$^{-4}$, and 5.0 × 10$^{-4}$ mole per mole of silver halide in Layers E1, E3 and E7, respectively.

Each of the thus-obtained samples 201 to 214 was subjected to wedge exposure (1/10 seconds, 10 CMS) and then to Process A, and the densities of magenta color images were then measured. The obtained results are shown in Table 8.

TABLE 8

| Sample No. | Content | Magenta image density Dmax | Dmin |
|---|---|---|---|
| 201 | Comparative example | 1.61 | 0.42 |
| 202 | Comparative example | 2.02 | 0.27 |
| 203 | Comparative example | 2.07 | 0.29 |
| 204 | Example | 2.26 | 0.22 |
| 205 | Example | 2.31 | 0.22 |
| 206 | Example | 2.23 | 0.21 |
| 207 | Example | 2.27 | 0.23 |
| 208 | Example | 2.33 | 0.23 |
| 209 | Example | 2.24 | 0.21 |
| 210 | Example | 2.31 | 0.23 |
| 211 | Example | 2.22 | 0.21 |
| 212 | Example | 2.27 | 0.21 |
| 213 | Example | 2.32 | 0.22 |
| 214 | Example | 2.26 | 0.21 |

It can be seen from Table 8 that Samples 204 and 214 containing both the nucleating agent and the nucleation accelerator of the present invention advantageously exhibit higher maximum color densities (Dmax) and lower minimum color densities (Dmin) than those of Samples 201 to 203.

The same results were obtained with respect to cyan color densities and yellow color densities.

EXAMPLE 13

Samples 201 to 214 obtained in Example 12 were kept (1) in a refrigerator 3 days and (2) for 3 days at 45° C. and 80% RH, and then subjected to exposure and processing which were the same as those in Example 12, and magenta color densities were measured.

The ratios of the maximum color densities obtained after the keeping in the refrigerator for 3 days to the maximum color densities after the keeping for 3 days at 45° C. and 80% RH are shown in Table 9.

TABLE 9

| Sample No. | Content | Dmax after the keeping and 80% at 45° C. / Dmax after the keeping in the refrigerator for 3 days |
|---|---|---|
| 201 | Comparative example | 0.72 |
| 202 | Comparative example | 0.76 |
| 203 | Comparative example | 0.74 |
| 204 | Example | 0.92 |
| 205 | Example | 0.91 |
| 206 | Example | 0.93 |
| 207 | Example | 0.90 |
| 208 | Example | 0.96 |
| 209 | Example | 0.94 |
| 210 | Example | 0.94 |
| 211 | Example | 0.90 |
| 212 | Example | 0.91 |
| 213 | Example | 0.95 |
| 214 | Example | 0.92 |

It can be seen from Table 9 that Samples 204 to 214 show smaller reductions in the Dmax values even if they are kept at high humidity, and thus have excellent properties.

The same results were obtained with respect to cyan color densities and yellow color densities.

EXAMPLE 14

Sample Nos. 201 to 215 obtained in Example 12 were subjected to wedge exposure (1/10 second, 100 CMS) and then to Process A, and the cyan, magenta and yellow cyan image densities were measured.

Samples 204 to 214 of the present invention advantageously showed lower sensitivities of cyan, magenta, and yellow colors of re-reverse negative images than those of the comparative samples 201 to 203.

EXAMPLE 15

Example 12 was repeated except that Process A was replaced by Process B. The same results were obtained.

EXAMPLE 16

Example 12 was repeated except that Process A was replaced by Process C. The same results were obtained.

What is claimed is:

1. A method for forming a direct positive image comprising imagewise exposing a photosensitive material comprising at least one layer of a previously unfogged internal latent image-type silver halide emulsion on a support and then conducting a surface color developing at pH 9.8 to 11.5 in the presence of a p-phenylenediamine compound and a nucleating agent, said nucleating agent being expressed by the following formula (I):

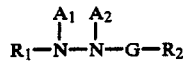

wherein $A_1$ and $A_2$ both denote hydrogen atoms or one of $A_1$ and $A_2$ denotes a hydrogen atom and the other denotes a sulfinic acid residue or an acyl group; $R_1$ denotes an aliphatic, aromatic or heterocyclic group; $R_2$ denotes a hydrogen atom or an alkyl, aryl, alkoxyl, aryloxy or amino group, at least one of $R_1$ and $R_2$ having at least one substituent which has a pKa of 6 or more and can dissociate into an anion; and G denotes a carbonyl, sulfonyl, sulfoxy, phosphoryl or iminomethylene group, and wherein said development is performed in the presence of at least one of a nitrogen-containing heterocyclic compound which serves as a nucleation accelerator for accelerating the function of said nucleation agent, and wherein said nucleation accelerator is expressed by the formulae (II), (III), (IV), (V), (VI), (VII) or (VIII):

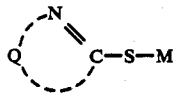

(II)

wherein Q denotes an atomic group necessary for forming a 5- or 6-membered heterocyclic ring which may be condensed with an aromatic carbon ring or an aromatic heterocyclic ring, M denotes a hydrogen or alkali metal atom, an ammonium group, or a group which can cleave under alkali conditions:

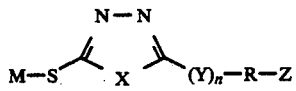

(III)

wherein M denotes the same as that of Formula (II); X denotes an oxygen, sulfur, or selenium atom, Y denotes —S—,

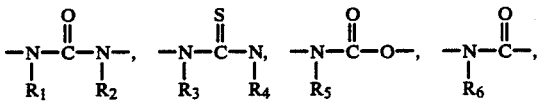

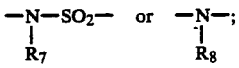

wherein $R_1$, $R_2$, $R_3$, $R_4$, $R_5$, $R_6$, $R_7$ and $R_8$ each denotes a hydrogen atom, a substituted or unsubstituted alkyl, aryl, alkenyl or aralkyl group; R denotes a straight or branched chain alkylene, alkenylene or aralkylene group, or an arylene group; Z denotes a hydrogen or halogen atom, a nitro or cyano group, or a substituted or unsubstituted amino, quaternary ammonium, alkoxyl, aryloxy, alkylthio, arylthio, heterocyclic oxy, heterocyclic thio, sulfonyl, carbamoyl, sulfamoyl, carbonamido, sulfonamido, acyloxy, sulfonyloxy, ureido, thioureido, acyl, heterocyclic, oxycarbonyl, oxysulfonyl, oxycarbonylamino or mercapto group; and n denotes 0 or 1:

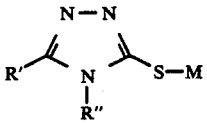

(IV)

wherein R′ denotes a hydrogen or halogen atom, a nitro, mercapto, or unsubstituted amino group, or $\text{—}(\text{—Y})_n\text{—R—Z}$; and R″ denotes a hydrogen atom, an unsubstituted amino group or $(\text{Y}')_m\text{R—Z}$ wherein Y′ denotes

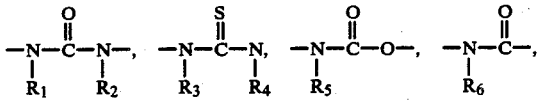

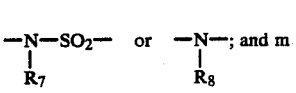

denotes 0 or 1; M, R, Z, Y, n, $R_1$ $R_2$, $R_3$, $R_4$, $R_5$, $R_6$, $R_7$ and $R_8$ each denoting the same as that of Formula III:

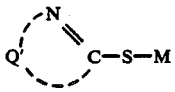

(V)

wherein Q′ denotes a triazaindene, tetraazaindene or pentazaindene; and M denotes the same as that of Formula (II):

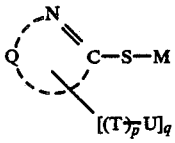

(VI)

wherein T denotes a divalent connecting group consisting of an atom selected from the group consisting of carbon, nitrogen, oxygen and sulfur; U denotes an organic group containing at least one of a thioether, amino, ammonium, ether or heterocyclic group; p denotes 0 or 1; q denotes 1 or 2; and Q and M denote the same as those of Formula (II):

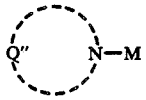

(VII)

wherein Q″ denotes an atomic group necessary for forming a 5- or 6- member heterocyclic ring which can produce imino silver; and M denotes the same as that of Formula (II):

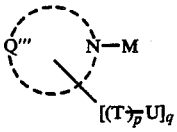

(VIII)

wherein Q‴ denotes an atomic group necessary for forming a 5- or 6-member heterocyclic ring which can produce imino silver; M denotes the same as that of Formula (II); and $\text{—}[(\text{T})_p\text{U}]_q$ denotes the same as that of Formula (VI).

2. The method of claim 1, wherein said photosensitive material contains a color image-forming coupler, said color image-forming coupler being nondispersible and producing or releasing a dye by the oxidative coupling with said developing agent.

3. The method of claim 1, wherein said nucleating agent is used in a processing solution in an amount of $10^{-5}$ to $10^{-1}$ mole per liter of said processing solution.

4. The method of claim 3, wherein said nucleating agent is used in said processing solution in an amount of $10^{-4}$ to $10^{-2}$ mole per liter of said processing solution.

5. The method of claim 1, wherein said nucleation accelerator is used in an amount of $10^{-6}$ to $10^{-2}$ mole per mole of silver halide.

6. The method of claim 5, wherein said nucleation accelerator is used in an amount of $10^{-5}$ to $10^{-2}$ mole per mole of silver halide.

* * * * *